US008535204B2

(12) United States Patent
Stacey

(10) Patent No.: US 8,535,204 B2
(45) Date of Patent: Sep. 17, 2013

(54) EXERCISE APPARATUS

(75) Inventor: Richard J. Stacey, Richmond Hill (CA)

(73) Assignee: Northern Response International Limited (CA)

( * ) Notice: Subject to any disclaimer, the term of this patent is extended or adjusted under 35 U.S.C. 154(b) by 318 days.

(21) Appl. No.: 12/859,619

(22) Filed: Aug. 19, 2010

(65) Prior Publication Data

US 2012/0046150 A1 Feb. 23, 2012

(30) Foreign Application Priority Data

Aug. 19, 2010 (CA) ..... 2711120

(51) Int. Cl.
*A63B 1/00* (2006.01)

(52) U.S. Cl.
USPC ..... 482/40; 482/904

(58) Field of Classification Search
USPC ..... 482/23, 35, 36, 37, 38, 39, 40, 41, 482/93, 94, 95, 96, 904, 131, 140–141; D21/662, 679, 691, 694, 797
See application file for complete search history.

(56) References Cited

U.S. PATENT DOCUMENTS

| | | | | | |
|---|---|---|---|---|---|
| D210,469 | S | | 3/1968 | Sejersen | |
| 3,707,285 | A | | 12/1972 | Martin | |
| 3,915,452 | A | * | 10/1975 | Winblad | 482/40 |
| 4,232,863 | A | | 11/1980 | Roach | |
| 4,286,782 | A | | 9/1981 | Fuhrhop | |
| 4,431,181 | A | | 2/1984 | Baswell | |
| 4,662,629 | A | * | 5/1987 | Plovie | 482/40 |
| D297,957 | S | | 10/1988 | Gordon, III | |
| 4,844,448 | A | * | 7/1989 | Niznik | 482/40 |
| 4,850,589 | A | | 7/1989 | Block | |
| 4,949,956 | A | | 8/1990 | Pobran | |
| 5,011,139 | A | | 4/1991 | Towley, III | |
| 5,046,722 | A | | 9/1991 | Antoon | |
| 5,299,990 | A | | 4/1994 | Mehlhoff | |
| D348,706 | S | * | 7/1994 | Harrell | D21/691 |
| 5,417,628 | A | * | 5/1995 | Vanderbleek | 482/40 |
| 5,752,903 | A | | 5/1998 | Chang | |

(Continued)

FOREIGN PATENT DOCUMENTS

| | | | |
|---|---|---|---|
| EP | 2138206 | A1 | 12/2009 |
| WO | WO-2004/085003 | A1 | 10/1994 |
| WO | WO-2009/067157 | A1 | 5/2009 |

OTHER PUBLICATIONS

Dip Bar, Dip Station, Dip Stand, Dip Machine, Pull Up Bar and More., http://www.ultimatebodypress.com; © 2008 Ultimate Body Press., (2008), 1 pg.

*Primary Examiner* — Oren Ginsberg
(74) *Attorney, Agent, or Firm* — Schwegman Lundberg & Woessner, P.A.

(57) ABSTRACT

A doorway exercise apparatus is described. In one implementation, there is provided an apparatus comprising two elongate handle struts spaced apart by a distance between shoulder width and doorway width, each handle strut having a longitudinal axis, the strut axes being substantially in a single plane; an elongate rest member having a longitudinal axis transverse to the strut axes, the elongate rest member comprising two rest surfaces spaced greater than a doorway width apart in a single plane; two elongate spaced-apart drop members each drop member having a longitudinal axis, each drop member axis substantially perpendicular to the rest member; and releasable attachment means from which the drop members depend; wherein the handle struts extend about one cubit away from the rest member in a direction opposite the rest surface.

32 Claims, 20 Drawing Sheets

(56) References Cited

U.S. PATENT DOCUMENTS

| | | | | |
|---|---|---|---|---|
| 6,033,351 | A * | 3/2000 | Sizemore et al. | 482/111 |
| 6,179,748 | B1 | 1/2001 | Barr | |
| 6,508,743 | B1 * | 1/2003 | Fortin | 482/41 |
| 6,514,182 | B1 | 2/2003 | Chhloeum | |
| 6,692,417 | B2 | 2/2004 | Burrell | |
| 7,108,636 | B1 * | 9/2006 | Garcia | 482/40 |
| 7,621,847 | B2 | 11/2009 | Lamle | |
| D633,156 | S * | 2/2011 | Caswell et al. | D21/679 |
| D633,961 | S * | 3/2011 | Loew et al. | D21/679 |
| 2005/0250619 | A1 * | 11/2005 | Daikeler et al. | 482/40 |
| 2010/0234193 | A1 * | 9/2010 | Friedman et al. | 482/133 |
| 2011/0245040 | A1 * | 10/2011 | Skipper | 482/38 |

* cited by examiner

EXERCISE APPARATUS

This application claims the benefit of priority under 35 U.S.C. §119 of Richard J. Stacey, Canadian Patent Application Serial Number 2,711,120, entitled "EXERCISE APPARATUS," filed on Aug. 19, 2010, the benefit of priority of which is claimed hereby, and which is incorporated by reference herein in its entirety.

TECHNICAL FIELD

The present disclosure relates to the field of exercise apparatuses and more particularly to the field of exercise apparatuses mountable to a doorframe.

BACKGROUND

Exercise devices are widely marketed. Examples include exercise devices for performing pull-ups or chin-ups. Such devices include bars that can be permanently or temporarily installed. Temporary devices are generally easy to mount, dismount and store.

There are many different models of exercise bars with common designs including, for example, bars that hang from other structures and bars that are held in place at least partially by expansion forces, brackets or a combination thereof. Expansion forces bar can include for example internal screw threads or spring loaded mechanisms. Exercise bars are sometimes mounted in doorways.

BRIEF DESCRIPTION OF THE DRAWINGS

Implementations will now be described, by way of example only, with reference to the attached figures, wherein:

FIG. 10 is a side view of a further example implementation of a hanging exercise device including use for supported exercises with offset rest member;

FIG. 20 is a perspective view of an implementation similar to that of FIG. 1 including optional attachments;

Like reference numerals are used throughout the FIGS. to denote similar elements and features.

DETAILED DESCRIPTION OF EXAMPLE IMPLEMENTATIONS

For the purposes of this disclosure, the term doorway will refer to the opening in a wall or solid structure, and the term doorframe will refer to the frame about a doorway including for example jambs, lintel, sills and any edging or moulding around the doorway.

In this description various implementations will be described. Some features will be described with regard an example implementation and not for other example implementations in order to efficiently describe the various implementations. It is understood that features from one implementation can be applied to other implementations.

In this description tubular is understood to include a hollow rounded cross-section. A rounded cross-section can include for example circular, elliptical, and obround cross-sections. In many applications it is possible to use members of alternate profiles, such as for example solid rounded cross-sections, or rectangular cross-sections. The cross-section of members can change along the length of a member. It is noted that those portions of members that are intended to be gripped by a user would preferably have rounded external cross-sections for comfort. Portions of members to be curved along the length of the member can be bent, for example, to form an elbow. Such bent portions can for example have a squashed circular (perhaps elliptical) cross-section formed during bending from an original circular cross-section.

Figure 1:
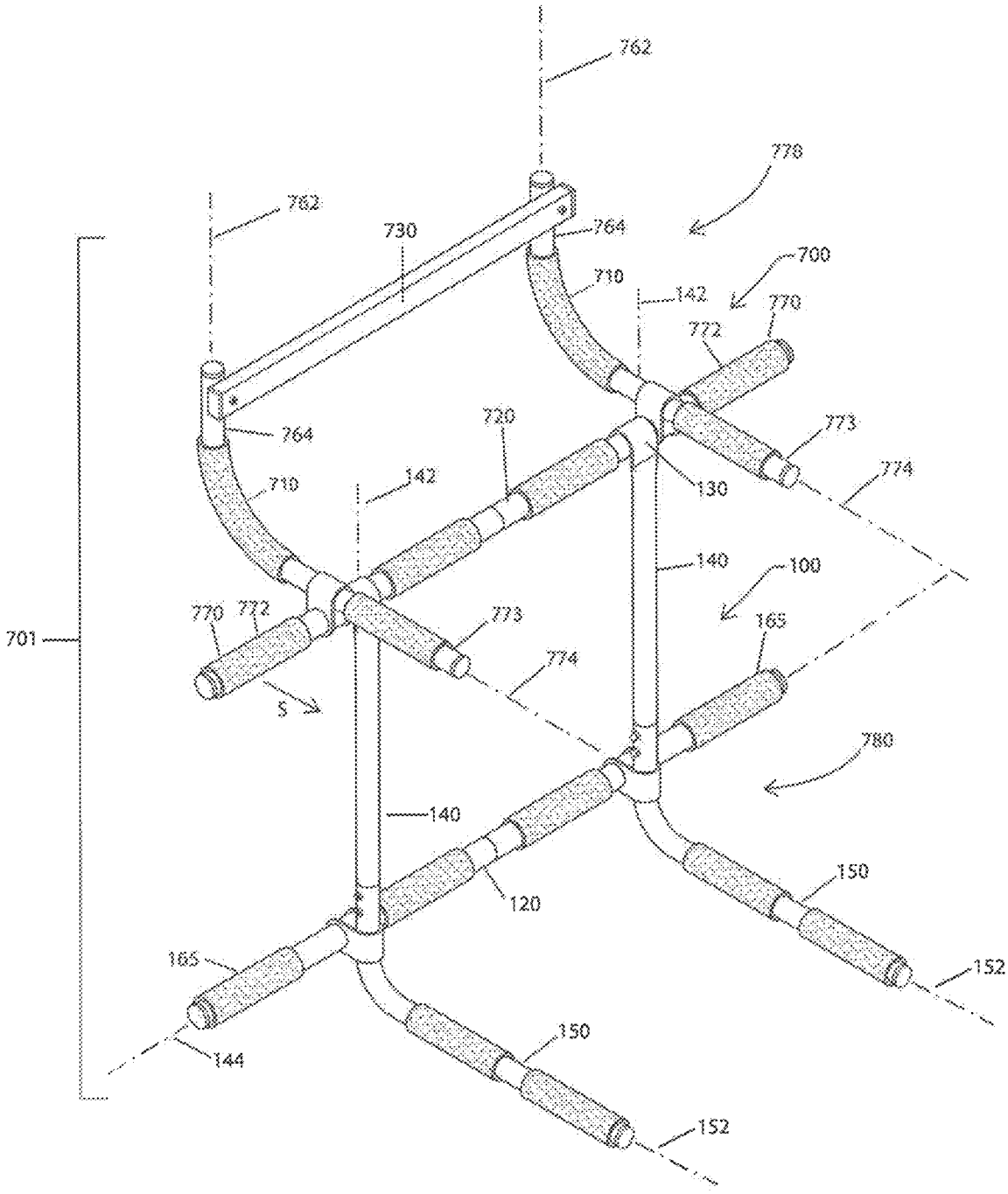
FIG. 1 is a perspective view of a multi-level exercise apparatus including implementations of the present disclosure.

Referring to FIG. 1, an exercise apparatus 701 has a first pair of drop members 140, a first rest member 120, and a first pair of handle struts 150.

Each drop member 140 having a longitudinal axis 142. The longitudinal axes 142 of the drop members 140 are substantially in a single plane. The drop members 140 are rigid to provide structural stiffness in three-dimensions for purposes described herein. The drop members 140 are elongate to provide spacing between the elements of the apparatus 701. The drop members 140 are spaced-apart Y from one another.

The rest member 120 has a longitudinal axis 144. The rest member 120 has a length X greater than the drop members 140 are spaced apart Y. The rest member 120 has two rest surfaces 165 (better shown in FIG. 2) that are substantially parallel to the rest member longitudinal axis 144. The rest surfaces 165 are at opposing ends 167 of the rest member 120. The rest member 120 is elongate to provide spacing between the elements of the apparatus 701. The rest member 120 is rigid to provide structural stiffness in three-dimensions for purposes described herein.

The handle struts 150 are spaced apart Z by at least hip width. Each handle strut 150 has a longitudinal axis 152. The strut axes 152 are substantially in a single plane. The handle struts 150 are elongate to provide support for exercises as described herein. The handle struts 150 are rigid to provide structural stiffness in three-dimensions for purposes described herein.

The rest member 120 is connected to the drop members 140 and the handle struts 150. In the implementation shown in FIG. 1 the drop members 140 are each connected to a respective one of the handle struts 150 each drop member 140 handle strut 150 combination (generally indicated at 154) can be continuous, for example formed from a tube. A tube combination 154 can have a substantially uniform circumference.

Whether or not a drop member 140 and a respective handle strut 150 are directly connected to one another, the axis 142 of the drop member 140 and the axis 152 of the handle strut can be in the same plane as shown in FIG. 1. In other implementations the axis 142 of the drop member 140 and the axis 152 of the handle strut can be offset from one another. Typically the apparatus 701 will be symmetrical about a central plane perpendicular to the longitudinal axis 144 of the rest member 120. Where the axis 142 of the drop member 140 and the axis 152 of the handle strut are offset from one another, the axes 142 of the drop members 140 are preferably further from the central plane than the axes 152 of the handle struts 150 for enhanced stability in use; however, where the connections between the elements of the apparatus 701 and between the drop members 140 and another structure from which the drop members 140 hang (as will be discussed herein), the axes 142 of the drop members 140 can be closer to the central plane than the axes 152 of the handle struts 150.

In other implementations the rest member 120, drop members 140, and handle struts 150 can be connected in alternate configurations. The rest member 120 is rigidly connected at least to the drop members 140 or to the handle struts 150. The handle struts 150 are rigidly connected at least to the respective drop members 140 or to the rest member 120. The drop members 140 are rigidly connected at least to the respective handle struts 150 or to the rest member 120.

Figure 7:
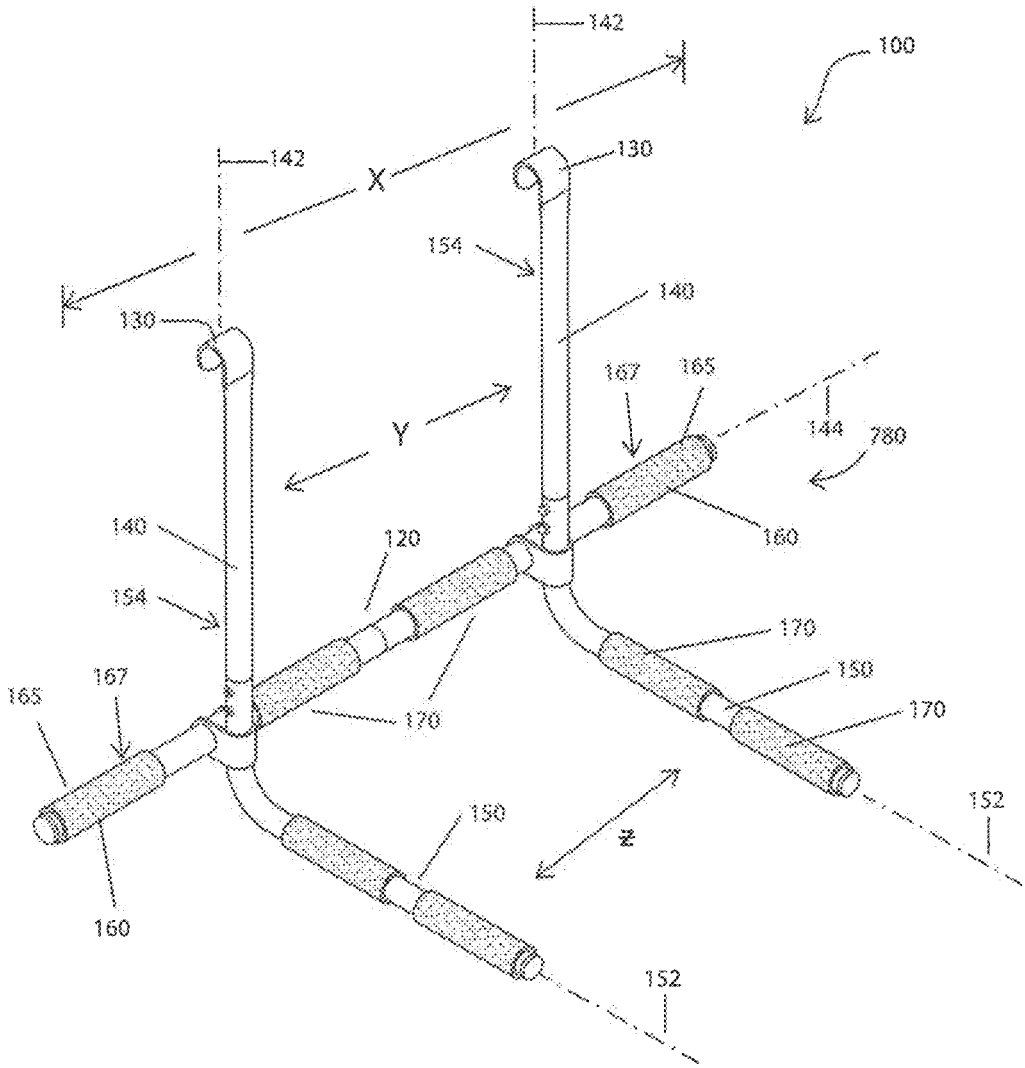
FIG. 7 is a perspective view of one implementation of a hanging exercise apparatus.

In the configuration shown in FIG. 7 the rest member 120 is shown on one side of the plane of the drop members 140, while the handle struts 150 extend away from the plane of the drop members 140 on an opposite side of the plane. Again, the specific relationship of the beginning of the handle struts 150 and the position of the rest member 120 on one side or the other of the drop members 140 can be altered with consequent modification in alternative implementations.

The rest surfaces 165 are substantially perpendicular to the axis 152 of the handle struts 150, the rest surfaces 165 are offset in a first direction Q from the longitudinal axis 144 of the rest member 120. The handle struts 150 extend away from the longitudinal axis 144 of the rest member 120 in a second direction R having a component opposite to the first direction Q.

The apparatus 701 has a second pair of drop members 764, second rest member 720, and a second pair of handle struts 773. The drop members 764 are similar to the drop member 140 in being substantially co-planar, rigid and spaced-apart and each drop member having a longitudinal axis 762. The rest member is similar to the rest member 120 in being elongate and rigid and having a longitudinal axis 766. The rest member 720 has a length substantially the same as the first rest member 120. The second rest member 720 also has two rest surfaces 770 substantially parallel to the second rest member longitudinal axis 766. The rest surfaces 770 are at opposing ends 772 of the rest member 720. The handle struts 773 are similar to the handle struts 150 in being rigid, elongate, and spaced-apart and having longitudinal axes 774 with the strut axes 774 being substantially in a single plane.

Again, the second rest member 720 is rigidly connected at least to the drop members 764 or to the handle struts 773, and the second pair handle struts 773 are rigidly connected at least to the respective drop members 764 or to the rest member 720. The second pair drop members 764 are rigidly connected at least to the respective second pair handle struts 773 or to the second rest member 720.

The second rest member rest surfaces 770 are substantially parallel to the plane of the second pair drop members 764. The second rest member rest surfaces are offset in the first direction Q from the longitudinal axis 766 of the second rest member 720. The second pair handle struts 773 extend away from the longitudinal axis 766 of the second rest member 720 in a third direction S having a component opposite to the first direction Q. The second direction R and the third direction S can be the same or different. The apparatus 701 may or may not have handle struts 773. The rest member 720 can be directly connected to the drop members 764 or connected through other elements such as handle struts 773 to the drop members 764.

The plane of the second pair drop members 764 is offset from the rest surfaces 770 in the first direction Q. The second pair drop members 764 terminate in a transverse rectilinear beam 730. The beam 730 and drop members 764 form a hanging mechanism for the rest member 720 and the handle struts 773.

The hanging mechanism, rest member 720 and handle struts 773 form an upper level exercise station 778 from which hanging exercises can be performed, such as are known with regard to chinning bars and the like.

The drop members 140, the rest member 120, and the handle struts 150 form a lower level exercise station 780 upon which supported exercises can be performed, and from which hanging exercises can be performed.

The first drop members 140 attach the lower exercise station 780 to the upper level exercise station 778. The upper level exercise station 778 is separated from the handle struts 150 and the rest member 120 by the drop members 140.

The upper exercise station 778 can be fixedly attached to the lower exercise station 780 to form a single exercise unit. An example of fixed attachment can be by way of unitary construction (dye molded). Alternatively, fixed attachment can be welding or clamps. Other examples will be recognized by those skilled in the art based on the teachings herein. Fixed attachment can prevent lateral movement while allowing rotational movement of the drop members 140 about the rest member 720 to allow the lower exercise station to self-orient to the orientation of the upper exercise station when installed. The upper exercise station 778 can take on a rotated orientation due to a mismatch with a doorway opening. Rotational self-orientation can assist with properly aligning the lower exercise station 780.

Figure 3:
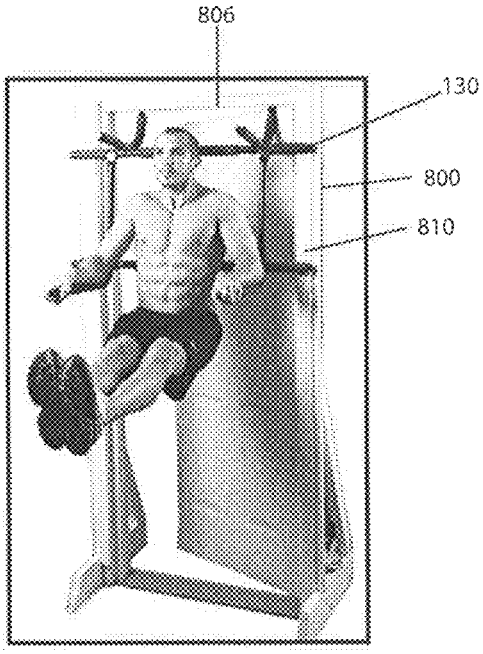
FIGS. 3, 4, 5, and 6 show example user positions in which the apparatus of FIG. 1 can be used.
Figure 4:
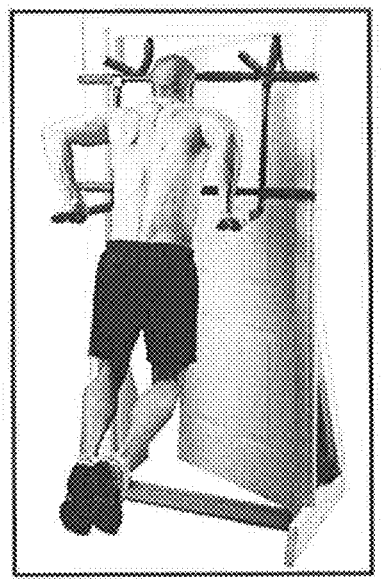
Figure 5:
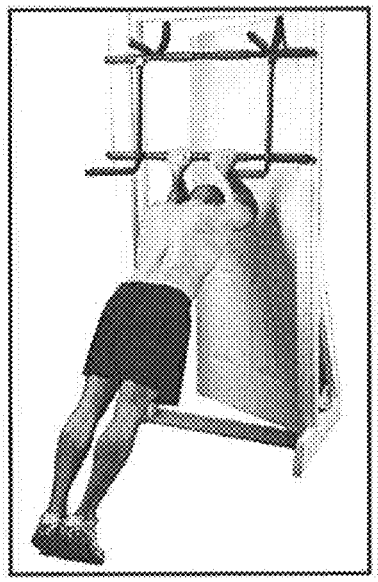
Figure 6:
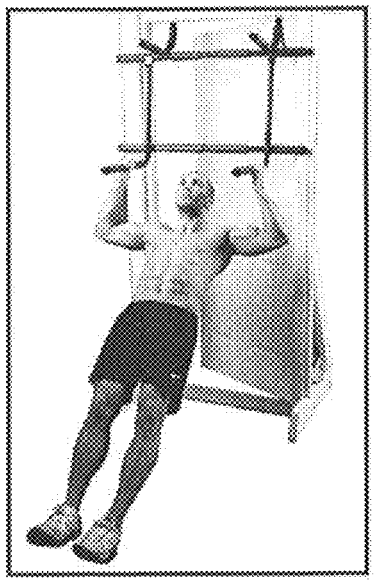

A variety of different exercises are possible on the implementations described herein. FIGS. 3 to 6 illustrate a number of example user positions from which exercises may be performed. FIGS. 3 and 4 illustrate example lower exercise station 780 supported exercises, while FIGS. 5 and 6 illustrate lower exercise station 780 hanging exercises. Such hanging exercises can be floor-supported as illustrated in FIGS. 5 and 6.

In FIG. 3, the user has his or her back to the elongate rest member 120 and his or her forearms rest on the elongate handle struts 150. By supporting his or her weight on the elongate handle struts 150, the user may lift his or her legs in a number of motions to exercise various muscles including the abdominal and oblique muscles.

Figure 23:
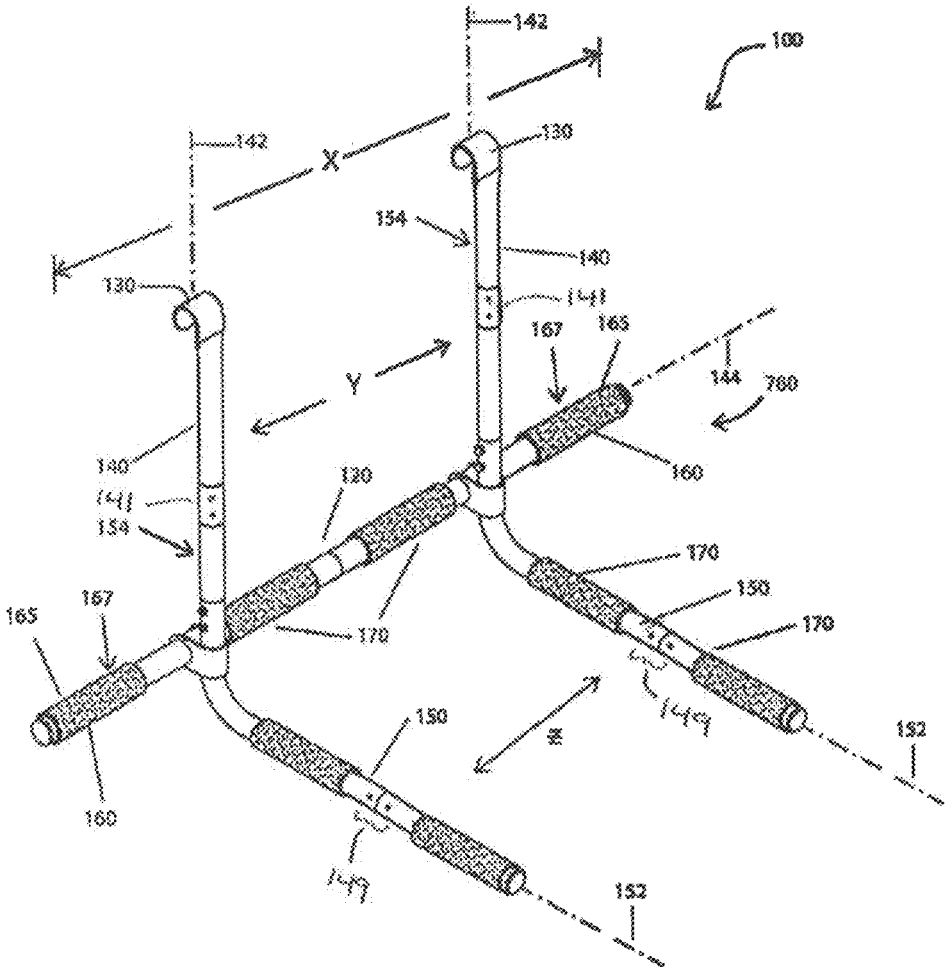
FIG. 23 is a perspective view of an implementation of a hanging exercise apparatus similar to that of FIG. 7 with an alternative example implementation of adjustable length drop members and adjustable length handle struts.
Figure 24:
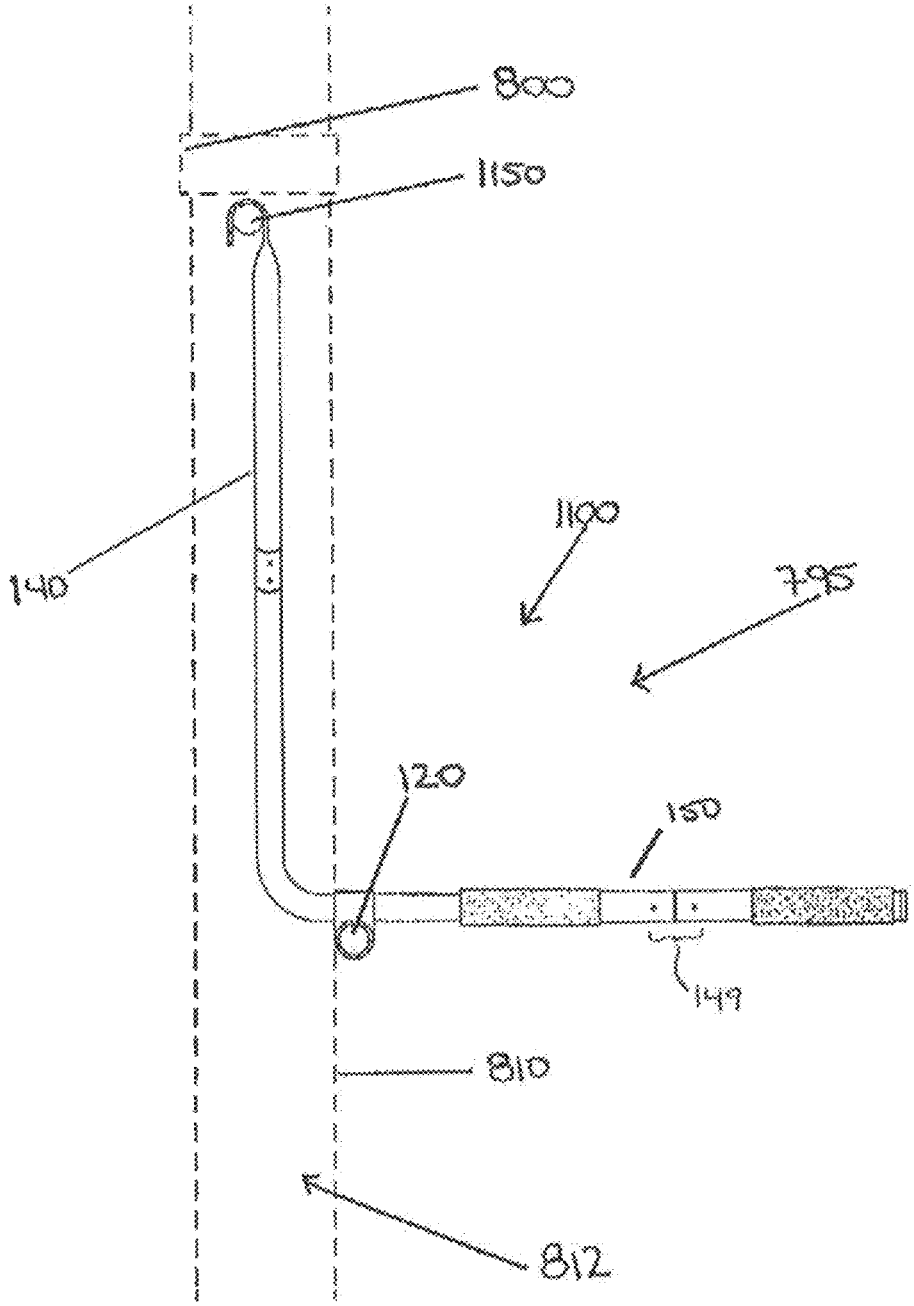
FIG. 24 is a side view of the implementation shown in FIG. 23.

Generally, the elongate drop members 140 have a length such that when the exercise apparatus 100 is used on a standard doorway, the elongated handle struts 150 are situated slightly higher than an average person's elbow height. This allows for a user to perform various exercises when in the position in FIG. 3 without his or her feet touching the floor, while allowing the user to move into the exercise position with relative ease. For a doorway with a height of 80 inches and a person with an elbow height of 40 inches, an appropriate length of the elongate drop members 140 would be between about 15 and 25 inches to perform the exercises but the exercise apparatus 100 could be used with elongated drop members 140 with lengths outside this range. In one example embodiment the length of the drop member is about 21 inches. In some implementations, the length of the elongate drop members 140 may be adjustable as shown in FIGS. 23 and 24 at adjustment mechanism 141; for example, using adjustment mechanisms such as those described herein with regard to the rest member 120.

The elongate handle struts 150 have a length such that a person may comfortably support his or her forearms on the elongate handle struts 150 when performing various exercises from the position illustrated in FIG. 3. A comfortable length is a cubit or the distance from a person's elbow to the tip of the middle finger which generally ranges from 17 to 21 inches. In some implementations, the length of the elongate handle struts 150 can fall outside this range. In other implementations, the length of the elongate handle struts 150 may be adjustable, as shown for example in FIGS. 23 and 24 at adjustment mechanism 149.

In FIG. 4, the user is facing the elongate rest member 120 and is supporting his or her weight on the elongated handle struts 150 using his or her hands. From this position, the user may lower and raise his or her body to exercise various upper body muscles. The user may optionally be facing in the opposite direction with his or her back to the elongate rest member 120. When the distance between the elongate handle struts 150 is around shoulder width, the user may focus more on exercising his or her triceps. When the distance between the elongate handle struts 150 is wider than shoulder width, the user may focus more on exercising his or her chest muscles. The handle struts 150 should be at least hip width apart to allow passage of the hips between the struts 150 during this exercise when the user is fully raised. Preferably, the handle struts 150 extend further from the rest member 120 than the handle struts 773, if any, extend from the rest member 720 such that a user is not impeded by, or uncomfortably close to, the handle struts 773 when performing supported exercises such as those described with respect to FIG. 4.

In FIG. 5, the user has his or her feet on the ground and is hanging from the exercise apparatus 100 with bent arms while facing downwards. By straightening his arms and depending on the positioning of his hands on the elongate rest member 120 or bases 150, the user may exercise various upper body muscles.

In FIG. 6, the user has his or her feet on the ground and is hanging from the exercise apparatus 100 while facing upwards. By pulling himself upwards, the user may exercise various upper body muscles. When in the positions illustrated by FIG. 5 or 6, by moving his or her feet closer or farther from the doorway, the user may decrease or increase the weight he is lifting thereby decreasing or increasing the difficulty of the exercise.

The example user positions shown in FIGS. 3-6 are for illustrative purposes and do not limit the positions or exercises contemplated by the present disclosure.

Reference is made to FIG. 7, wherein the lower exercise station 780 in separately shown as an exercise apparatus 100. Further example implementation elements of the lower exercise station 780 will be described. It is to be recognized that the further example implementation are examples only and do not limit the general description provided above. The exercise apparatus 100 comprises an elongate rest member 120, two hooks 130, two elongate drop members 140, and two elongate handle struts 150.

The elongate rest member 120 can be a rigid tubular member such as a tubular bar (or simply a tube) as illustrated in the example implementation in FIG. 7.

In some implementations, the elongate rest member 120 is transversely connected to each of the elongate drop members 140. In FIG. 7, the elongate rest member 120 is connected to the lower portion of the elongate drop members 140; however, the elongate rest member 120 could connect to the elongate drop members 140 at any point along their lengths. In the example implementation shown in FIG. 7, the elongate rest member 120, the elongate drop members 140 and the elongate handle struts 150 extend in substantially orthogonal directions. In other implementations, the angles between the elongate rest member 120, the elongate drop members 140, and the elongate handle struts 150 can be any angles that provide structural stability and allow a user to perform various exercises, examples of which will be described herein.

In some implementations, the elongate rest member 120 is transversely connected to each of the elongate handle struts 150. In other implementations, the elongate rest member 120 is transversely connected to both the elongate drop members 140 and the elongate handle struts 150.

When the exercise apparatus 100 is in use, the elongate rest member 120 provides torsional support to the elongate drop members 140 and elongate handle struts 150. The elongate rest member 120, elongate drop members 140 and elongate handle struts 150 can be composed of any rigid material, such as metal, wood, or a composite or synthetic material, that allows the members to maintain their structural integrity and shape when a user is doing various exercises on the exercise apparatus 100.

The hooks 130 may be used to mount the exercise apparatus 100 on a doorway exercise bar or any substantially horizontal tubular member. In other implementations, the exercise apparatus 100 may be mounted using any other releasable attachment means including but not limited to pins, rings, clips, ropes, loops, and straps, and other mechanisms for hooking, looping or otherwise attaching to an exercise bar. Hook 130, for example, is releasably attachable to the second rest member 720. The drop members 140 depend from the releasable attachment means.

Figure 8:
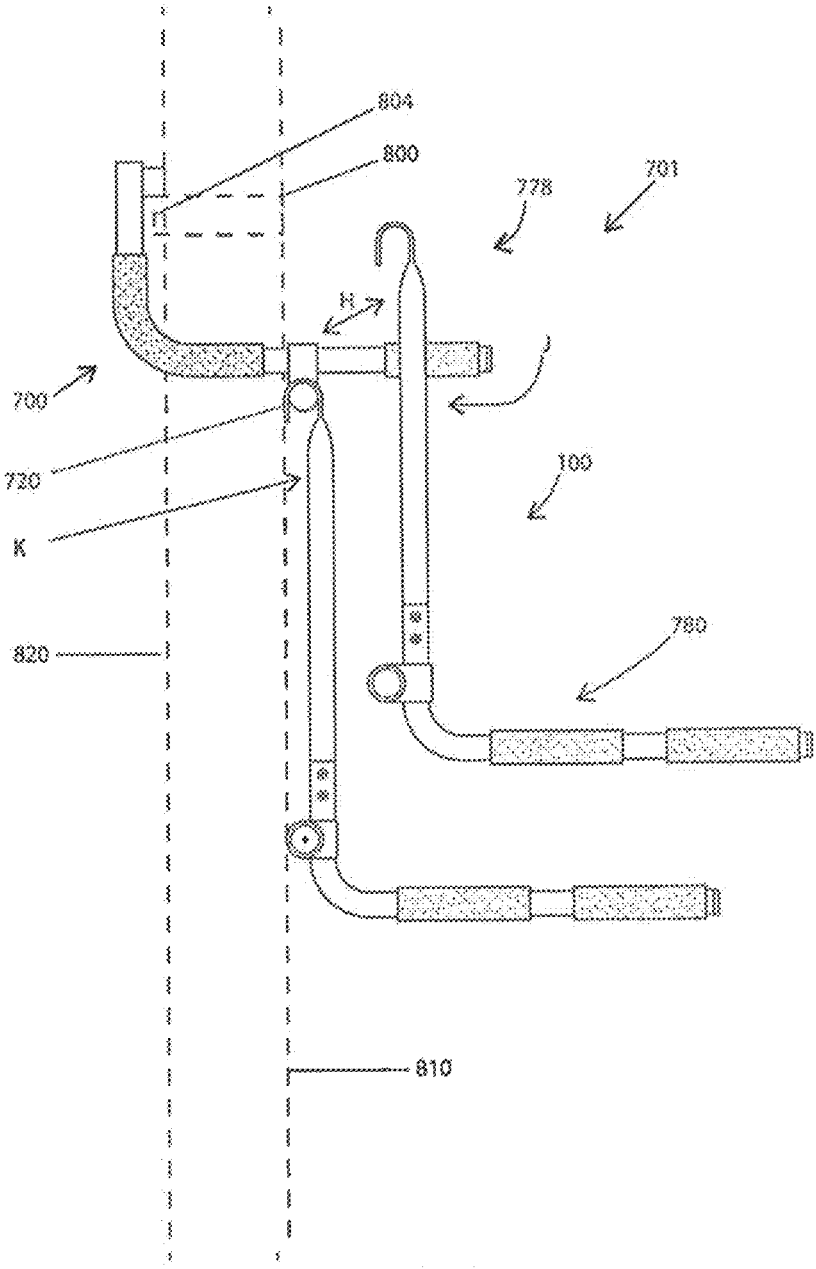
FIG. 8 is a side elevation view of an implementation of hanging exercise device.

Referring to FIG. 8, in use, hanging the drop members 140 can include releasably attaching the drop members 140 to an elongate bar, such as rest member 720. Releasably attaching the drop members 140 can be performed by hooking the hooks 130 of drop members 140 over the rest member 720 as indicating by movement H between hanging (attached) position K and released (unattached) position J.

Figure 9:
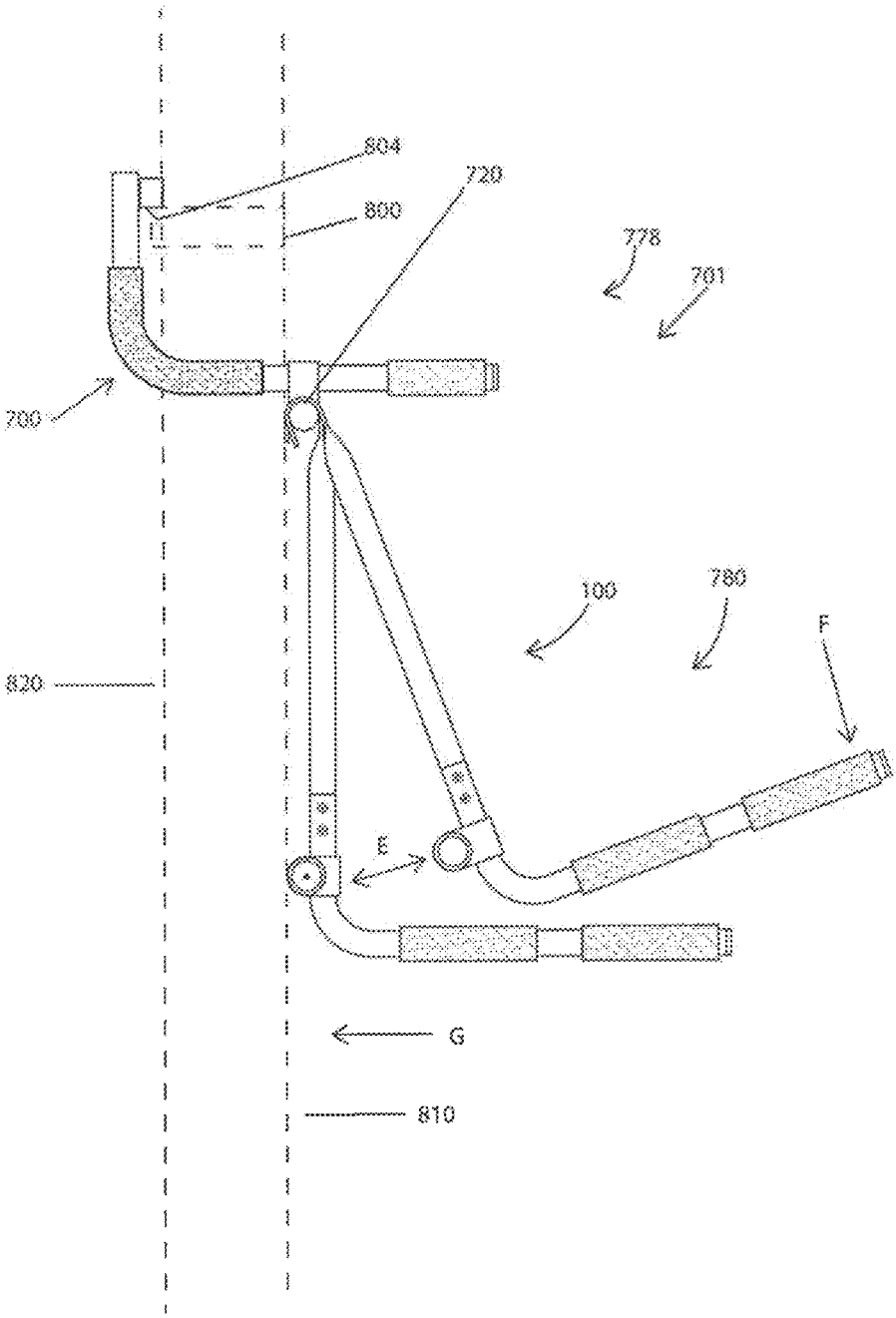
FIG. 9 is a side elevation view of an example implementation of rotationally mounting a hanging exercise device.

Referring to FIG. 9, an example is shown of rotational movement of lower level exercise station 780 (in this case exercise apparatus 100) about rest member 120 as indicated at E. This can provide the self-adjustment described early. The rotational movement can be cause initially by gravity pulling down on the handle struts 150, as indicated at F, such that the rest surfaces 165 of rest member 120 are driven towards a vertical surface, such as wall surface 810, as indicated at G. During exercise, hanging or supported exercises performed on handle struts 150 further exert forces F that cause rotational movement E to drive the rest member 120 in the direction G. Once the rest surfaces 165 engage the vertical surfaces (in this case 810), the rest surfaces 165 provide a stop for the apparatus 100 to prevent further rotational movement E and a fulcrum such that the apparatus 100 attempts to pivot about rest member 120 which is resisted, for example by drop members 140 attached to rest member 720.

As shown by example in FIGS. 4-6 and 8-9, in use, a user hangs the drop members 140 of an exercise apparatus 100 having a first pair of rigid elongate spaced-apart drop members 140 each drop member 140 having a longitudinal axis 142, the longitudinal axes 142 of the drop members 140 being substantially in a single plane; a rigid elongate first rest member 120 having a longitudinal axis 144, the rest member 120 having a length greater than the drop members 140 are spaced apart, the rest member 120 comprising two rest surfaces 165 substantially parallel to the rest member longitudinal axis 144, the rest surfaces 165 at opposing ends 167 of the rest member 120; and a first pair of rigid elongate handle struts 150 spaced apart by at least hip width, each handle strut 150 having a longitudinal axis 152, the strut axes 152 being substantially in a single plane; wherein the rest member 120 is rigidly connected at least to the drop members 140 or to the handle struts 150, and the handle struts 150 are rigidly connected at least to the respective drop members 140 or to the rest member 120, and the drop members 140 are rigidly connected at least to the respective handle struts 150 or to the rest member 120; and wherein the rest surfaces 165 are offset in a first direction Q from the longitudinal axis of the rest member 120, and the strut members 150 extend away from the longitudinal axis of the rest member in a second direction R having a component opposite to the first direction Q. The user then pushes down on the handle struts 150 to perform supported exercises and to engage the rest surfaces 165 with respective substantially vertical surfaces 810 to support the handle struts 150.

Further examples of exercise apparatuses for hanging and pushing down to perform supported exercises while engaging a rest member are described herein.

For example, referring to FIG. 10 an exercise apparatus 1000 provides a single level exercise station 790 hanging from a doorframe sill 804 such that supported exercises can be performed. The exercise apparatus 1000 has a rest member 120 and handle struts 150, and drop members 1400. The drop members 1400 are similar to the drop members 140; however, the drop members 1400 extend directly to beam 730. The drop members 1400 longitudinal axes 1420 are spaced away from rest the respective surfaces 165 by a distance in the direction Q. The distance is approximately the anticipated depth between hanging surface (sill 804) and a vertical surface against which the rest surfaces 165 are driven, for example the approximate depth between wall surfaces 820 and 810. Rest member 120 is attached to the handle struts 150 from beneath to allow for the change in the offset between the drop members 1400 and the rest member 120. This is an example of an alternate configuration of the relationship of the handle struts 150 and the position of the rest member 120 as discussed previously.

Figure 11:
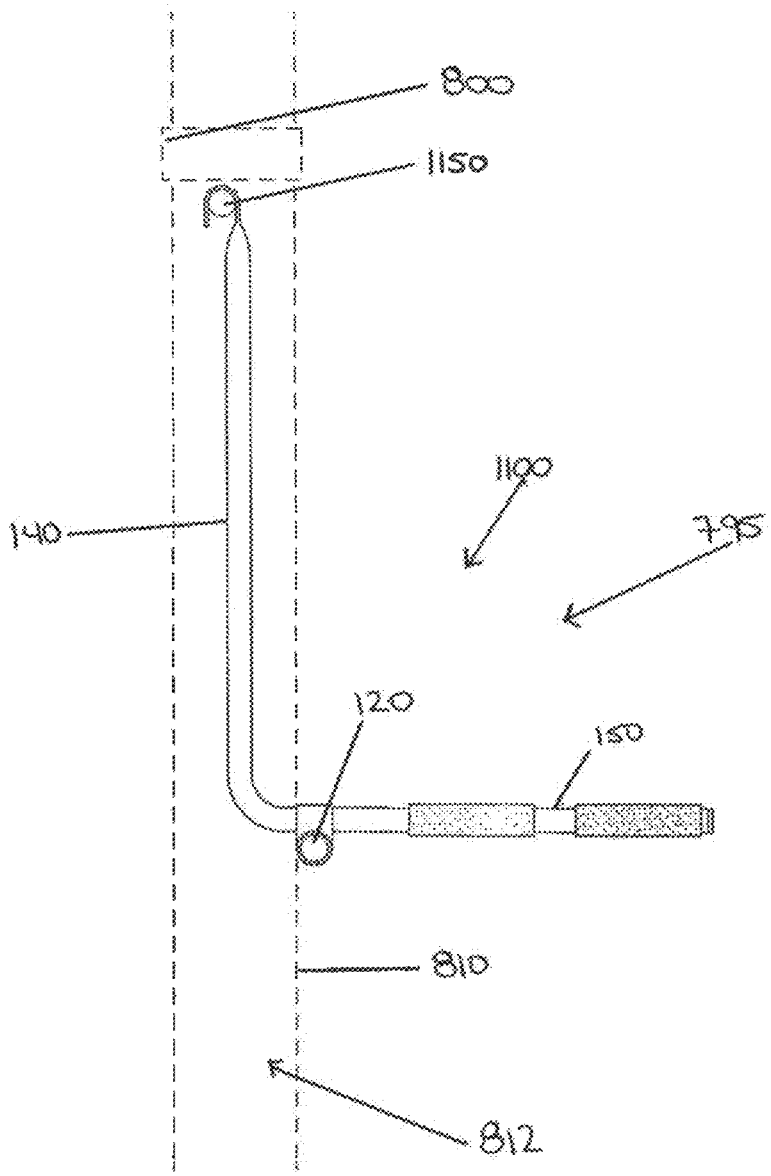
FIG. 11 is a side view of a another example implementation of a hanging exercise device including use for supported exercises with offset rest member.

For example, referring to FIG. 11 an exercise apparatus 1100 provides an exercise station 795 hanging from an exercise bar 1150 mounted within a door opening between sides of a doorframe (one side 812 of which is referenced on FIG. 11. The apparatus 1100 is hung in a manner similar to the apparatus 100 from the bar 1150. The rest member 120 is again offset from the drop members 140 to allow for the offset between the bar 1150 and the wall surface 810. The rest member 120 is connected to the struts 150 in the configuration shown in FIG. 10. It is understood that in both apparatuses 1000, 1100 the rest member 120 could be attached above the handle struts 120, for example. The exercise station 795 is a lower level exercise station 795 providing supported exercises for the exercise bar 1150.

When the exercise apparatus 100 is in use, the elongate rest member 120 can, optionally, provide a frictional interface with the doorframe or wall. For example, referring again to FIG. 7, this interface is provided by two outer grip covers 160. The outer grip covers provide rest surfaces 165 which contact the doorframe or wall. Without the grip covers 160 the rest surface 165 can be provided, for example, by an outer surface of the tubular rest member 120. The outer grip covers 160 can be made of foam padding or any other material that can provide a frictional surface when contacting a typical doorframe 800 or wall surface 820. The elongate rest member 120 is generally longer than the width of a standard doorway to allow the rest surfaces to contact the doorframe or wall surface on either side of the doorway. A standard doorway may be between 29 and 38 inches. In some implementations, the elongate rest member 120 can be adjustably extended or shortened to accommodate different doorways.

The respective rest surfaces 165 can include surface areas spaced-apart by at least a width of a doorway opening.

Alternatively, other implementations may provide rest surfaces 165 by any other means in place of the outer grip covers 160. The rest surfaces 165 may be provided by any covering, coating, material, or attachment to the elongate rest member 120 that provides sufficient friction to resist movement when the exercise device 100 is in use. This can assist in stabilizing the apparatus when in use. This can assist in protecting vertical surfaces which the rest surfaces 165 engage, such as respective wall surfaces 820 on either side of a doorway.

FIG. 7 also shows four optional user grip covers 170 which can be gripped by a user to provide more comfortable and less slippery handholds when exercising.

Figure 2:
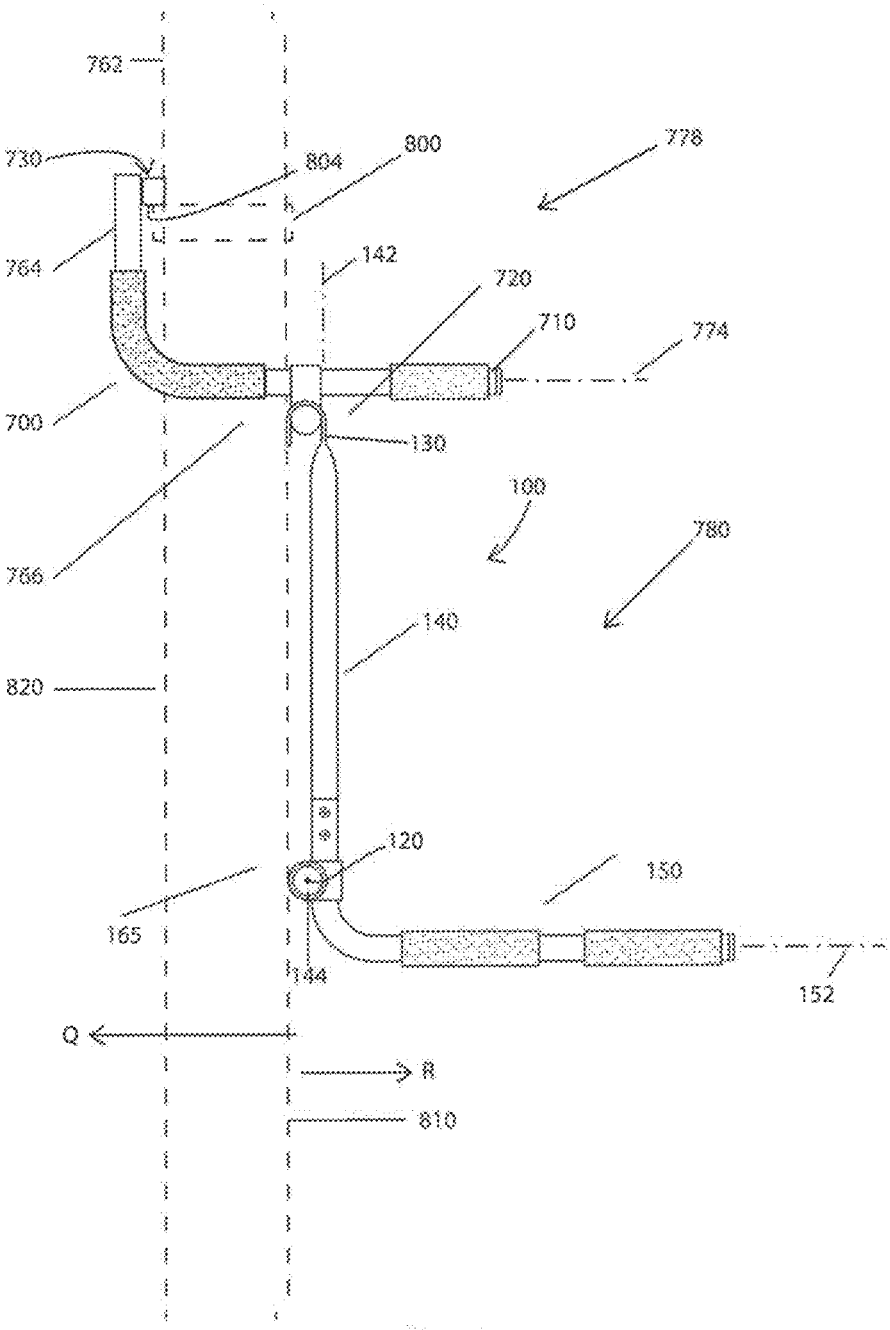
FIG. 2 is a side elevation view of the apparatus shown in FIG. 1.
Figure 12:
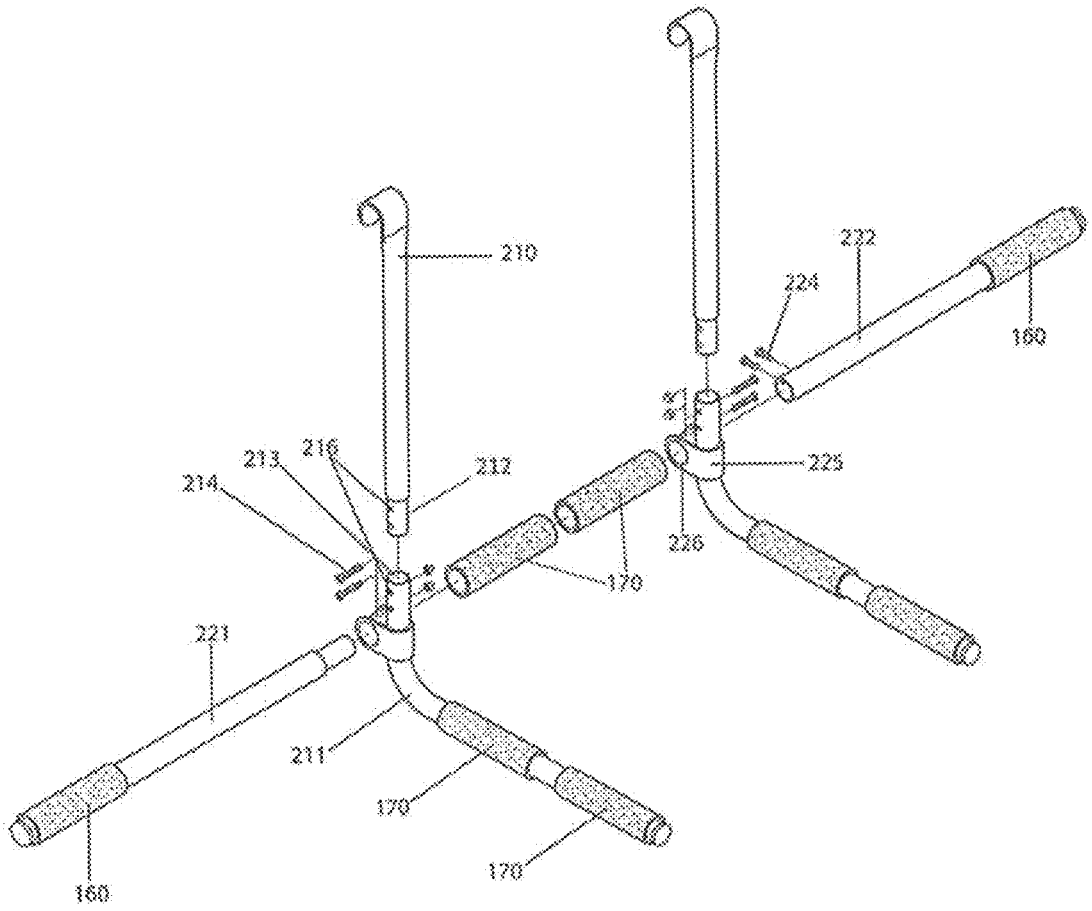
FIG. 12 is an example exploded perspective view of the implementation shown in FIG. 7.

Referring to FIG. 12, in some implementations, the elongate rest member 120, elongate drop members 140 and elongate handle struts 150 may be a single piece. In other implementations, these members 120, 140, 150 may be coupled from two or more pieces as illustrated in FIG. 2.

In the example implementation shown in FIG. 12, elongate drop members 140 are assembled from two separate pieces. The first piece 210 is coupled to the second piece 211 by inserting a telescoping portion 212 of the first piece into a receiving portion 213 of second piece. These pieces are secured by nuts 214 and bolts 215 inserted through corresponding holes 216 in the first 210 and second 211 pieces. In FIG. 12, the second pieces 211 comprise the lower portion of the elongate drop members 140 and the elongate handle struts 150. The separate pieces illustrated by this example are not limiting to the present disclosure. Other implementations may include any number of pieces that may be connected by any means which provide sufficient structural strength to withstand the forces on the exercise apparatus 100 when in use.

Similarly, in FIG. 12, the elongate rest member 120 is assembled from a first section 221 and a second section 222.

The first 221 and second 222 sections may be coupled in the same manner as the elongate drop members 140 described above and held in place by bolts 224. The two elongate rest member sections 221, 222 slide through and form a snug fit with the outer grip covers 160 and user grip covers 170.

In this implementation, the elongate rest member 120 is connected to each elongate drop members 140 by a collar 225 which wraps around the elongate drop members 140 and has a pair of openings 226 through which the elongate rest member 120 is inserted. When connected to the elongate rest member 120, the elongate drop members 140 are spaced apart which provides torsional stability to the apparatus 100.

In this implementation, the elongate handle struts 150 are the same distance spaced apart as the elongate drop members 140. The distance between the elongate handle struts 150 should be large enough to allow a user's torso to fit between them and to provide sufficient leeway for the user's arms to extend a comfortable distance away from the user's torso to perform various exercises. Generally, the distance between the elongate handle struts 150 is less than the width of a standard doorway, and is approximately shoulder width or between 16 and 26 inches.

Figure 13:
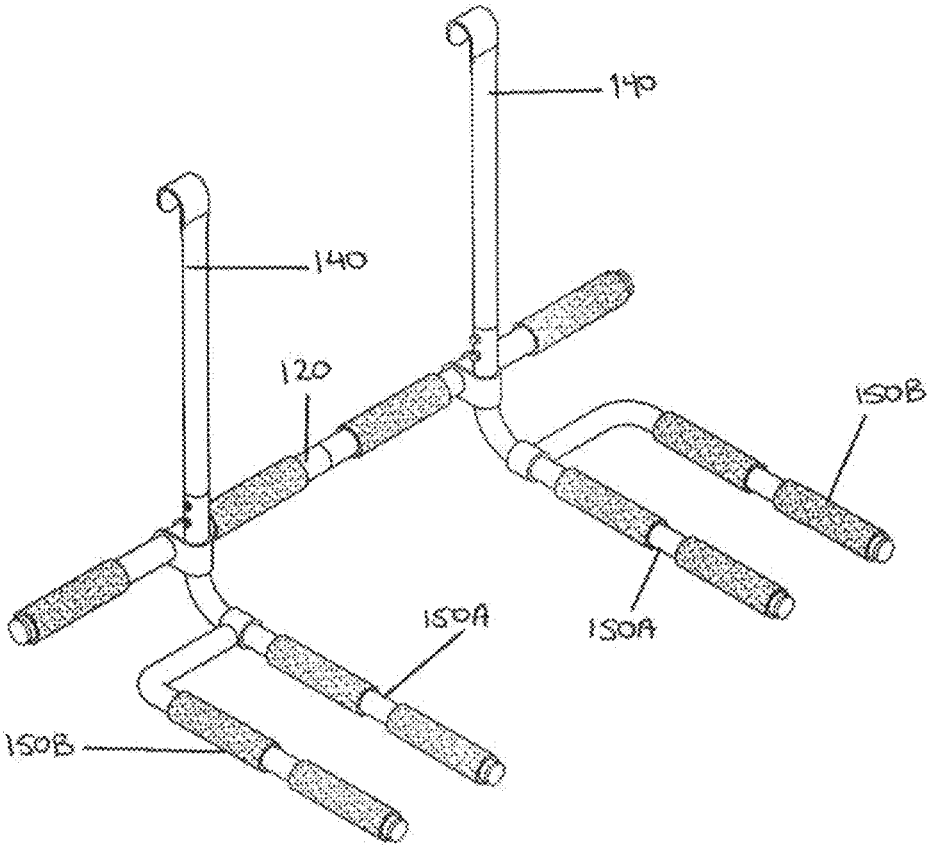
FIG. 13 is a perspective view of an example implementation of a hanging exercise device including use for supported exercises with a second pair of handle struts.

Referring to FIG. 13, in another example implementation, the exercise apparatus 100 can have more than a pair of elongate handle struts 150 extending away from the elongate rest member 120. In some implementations, the elongate handle struts are positioned in pairs and extend away from the elongate rest member 120. For example in FIG. 13, a first pair of elongate handle struts 150A extend at a first distance apart from the elongate rest member 120 and the elongate drop members 140, while a second pair or elongate handle struts 150B lying in the same plane as the first pair of elongate handle struts 150A extend away from the elongate rest member 120 a second distance apart. These additional handle struts allow for a user to have different grip positions when performing various exercises. In various implementations, the additional handle struts 150B can extend from the elongate drop members 140, from the elongate rest member 120 or from other pairs of elongate handle struts 150.

Figure 14:
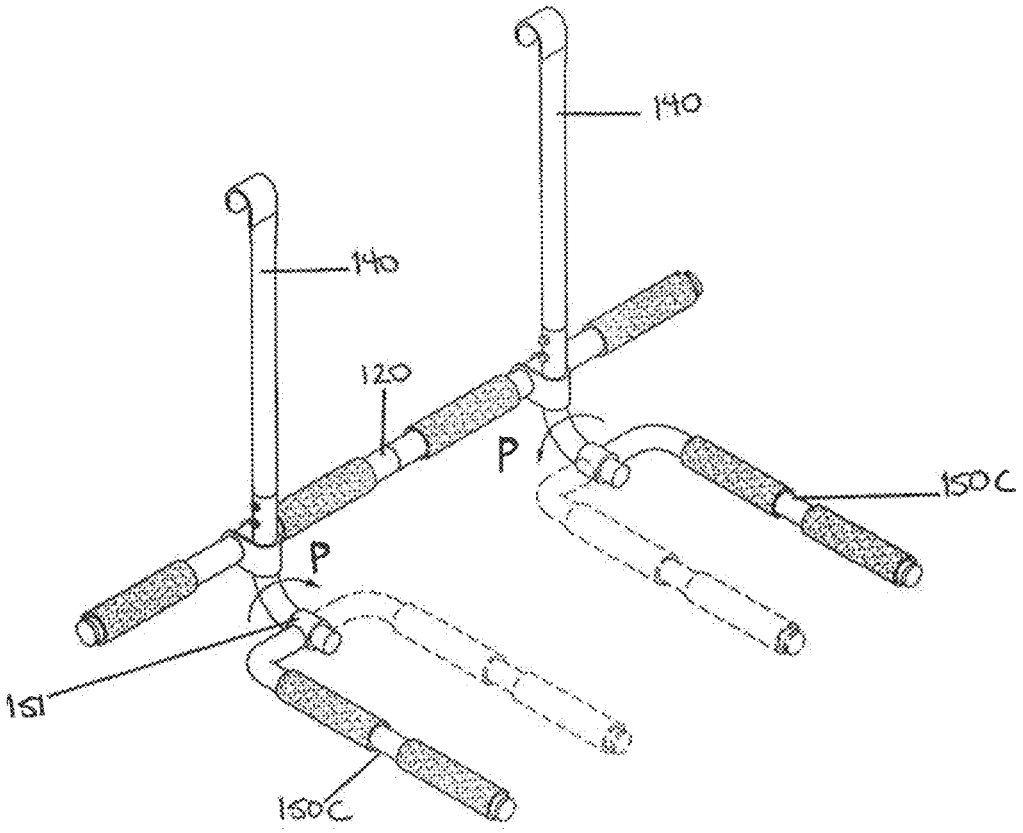
FIG. 14 is a perspective view of an implementation of a hanging exercise apparatus similar to that of FIG. 7 with an alternative example implementation of adjustable width strut handles.

Referring to FIG. 14, in another example implementation, the space between the elongate handle struts 150 can be in-situ (for example, when apparatus 100 is attached to upper level exercise station 778) adjustable by altering the configuration of the handle struts 150. For example, the elongate handle struts 150 can be curved as illustrated in FIG. 14. These curved handle struts 150C can be positioned to extend away from the elongate rest member 120 while curving away from the other curved handle strut 150C. The curved handle struts 150C can also be positioned to curve towards each other as illustrated by the dotted lines in FIG. 14. Thus the respective handle struts 150 can each be moved from a first further position to a second closer position to adjust the space between the struts 150 as indicated at P. These different orientations of the curved handle struts 150C can allow a user to perform variations of exercises such as narrow dips or wide dips. In some implementations, the curve handle struts 150C may be adjustable to curve in different directions. In some implementations, this adjustment can be made by providing making the curved handle struts 150C releasably attachable to the exercise device 100 in different orientations. In some implementations, the positioning of the curved handle struts 150C may be selectively rotatable about a pivot 151. In other implementations, the handle struts 150 may be any shape which allows them to be adjustably positioned to vary the distance between the axes of the handle struts. The above is an example showing the distance the handle struts 150 are spaced-apart can be adjustable.

Figure 15:
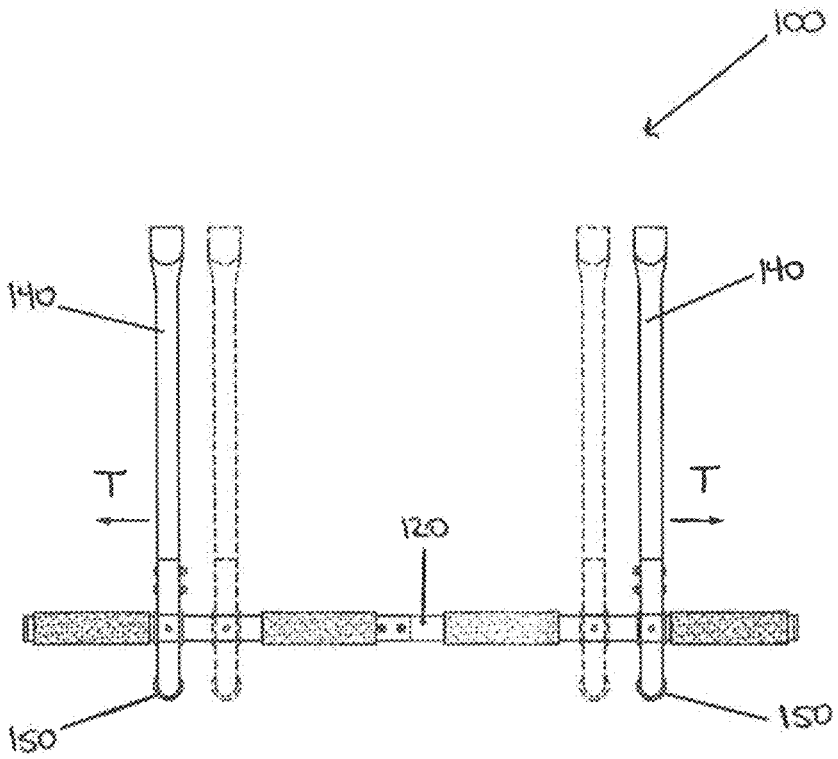
FIG. 15 is a rear elevation view of an example implementation of width adjustable strut handles.

Referring to FIG. 15, in some implementations, the distance between the elongate drop members 140 may be adjustable for different exercises or to better accommodate users of different sizes. As seen in FIG. 15 which shows a rear elevation view of an example implementation, the elongate rest member 120 may have a series of radial buttons along its length. By varying the button with which each elongate drop member 140 is engaged, the user may thereby adjust the distance between the elongate drop members 140.

In some implementations, the position of the elongate drop members 140 may be varied over any number of buttons or by any other means for selectively securing an elongate drop member's 140 position along the length of the elongate rest member 120. In other implementations, the position of the elongate drop members 140 may be statically predetermined and may not allow for adjustment.

In the implementations described above, the elongated rest member 120 is adjustably or statically connected to the elongate drop members 140; however, in other implementations the elongated rest member 120 can be adjustably or statically connected to the elongate handle struts 150 using the same mechanisms described above or using any other mechanisms. In some implementations, the distance between the elongate handle struts 150 may be adjusted by adjusting the length of the elongate rest member 120.

Figure 16:
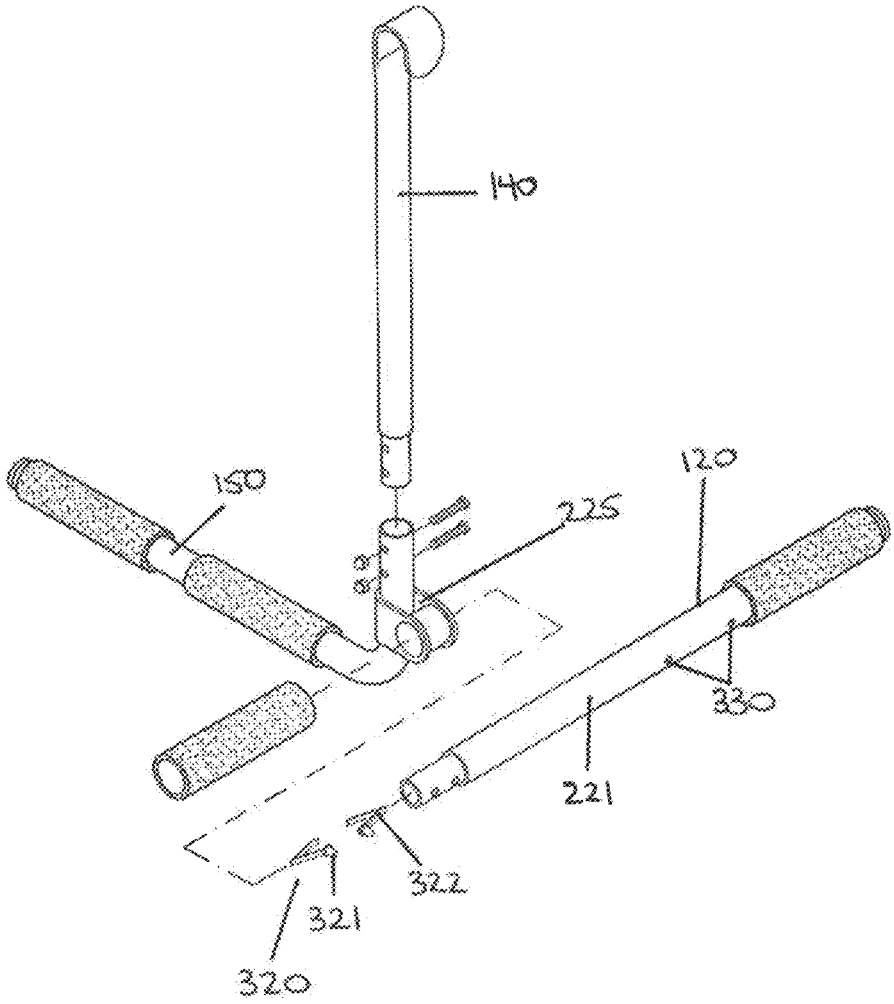
FIG. 16 is an exploded reverse-angle perspective view of a portion of the implementation shown in FIG. 7 with quick release.

Referring to FIG. 16, in some implementations, elongate drop members 140 may be held in place by a button extending radially from the outer surface of the elongate rest member 120. In FIG. 16, which shows an exploded, reverse-angle perspective view of a portion of the example exercise apparatus in FIG. 12, two buttons 320 are provided by pegs 321 connected to v-shaped springs 322. These buttons 320 are positioned inside the elongate rest member 120 and are aligned such that the pegs 321 extend through openings 330 and radially outward from the longitudinal axis elongate rest member 120.

Figure 17:
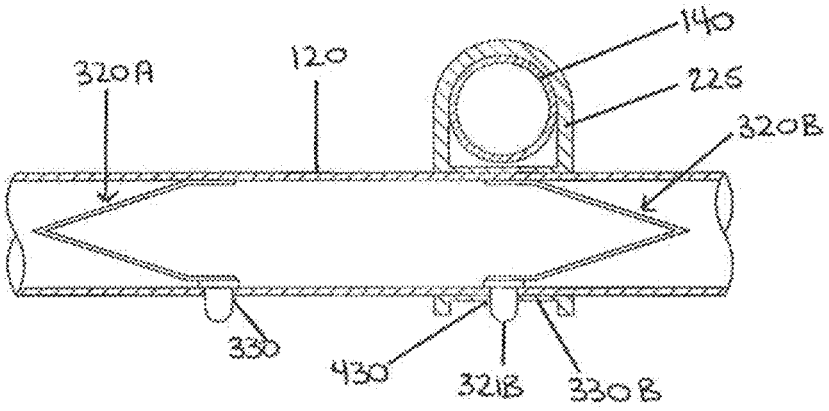
FIG. 17 is a cross-sectional view of an example implementation of a quick release mechanism in a locked position.
Figure 18:
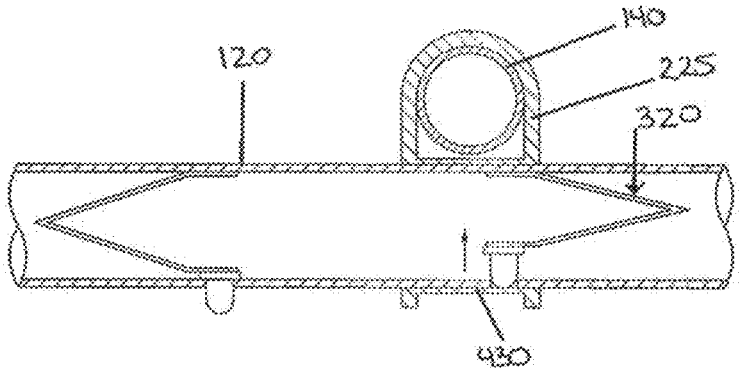
FIG. 18 is a cross-sectional view of the example implementation of a quick release mechanism of FIG. 17 in an unlocked position.
Figure 19:
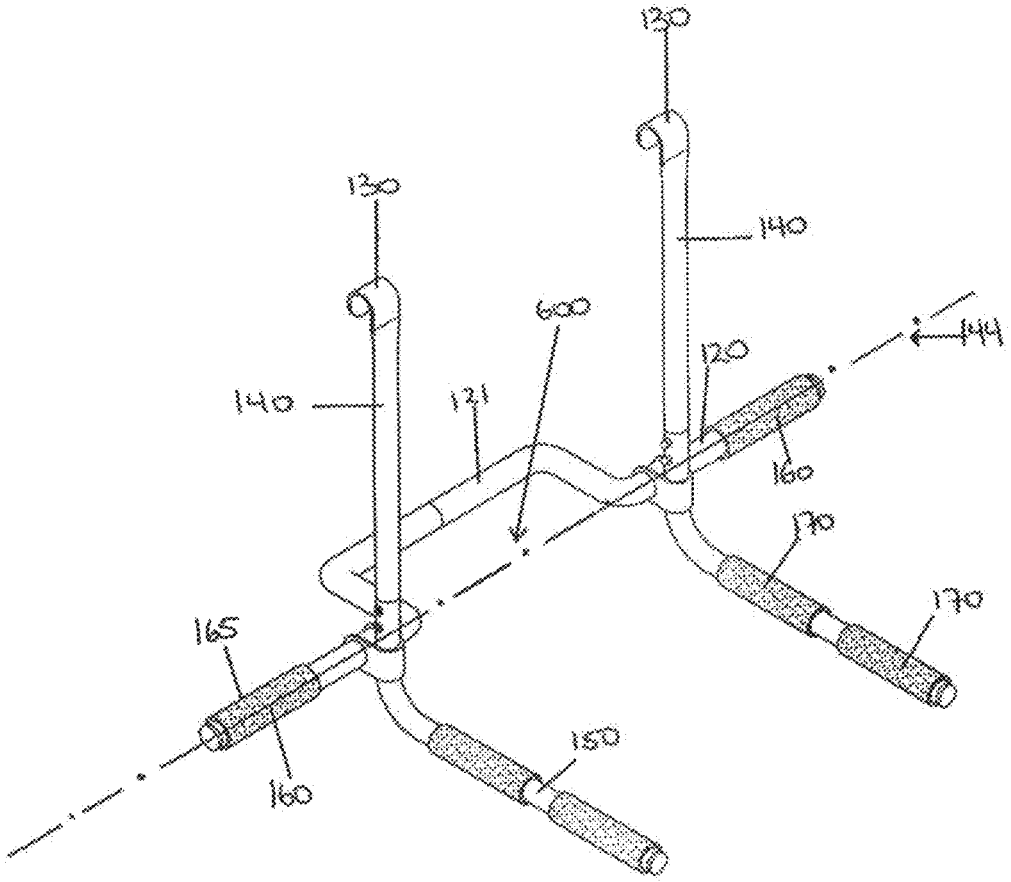
Figure 30:
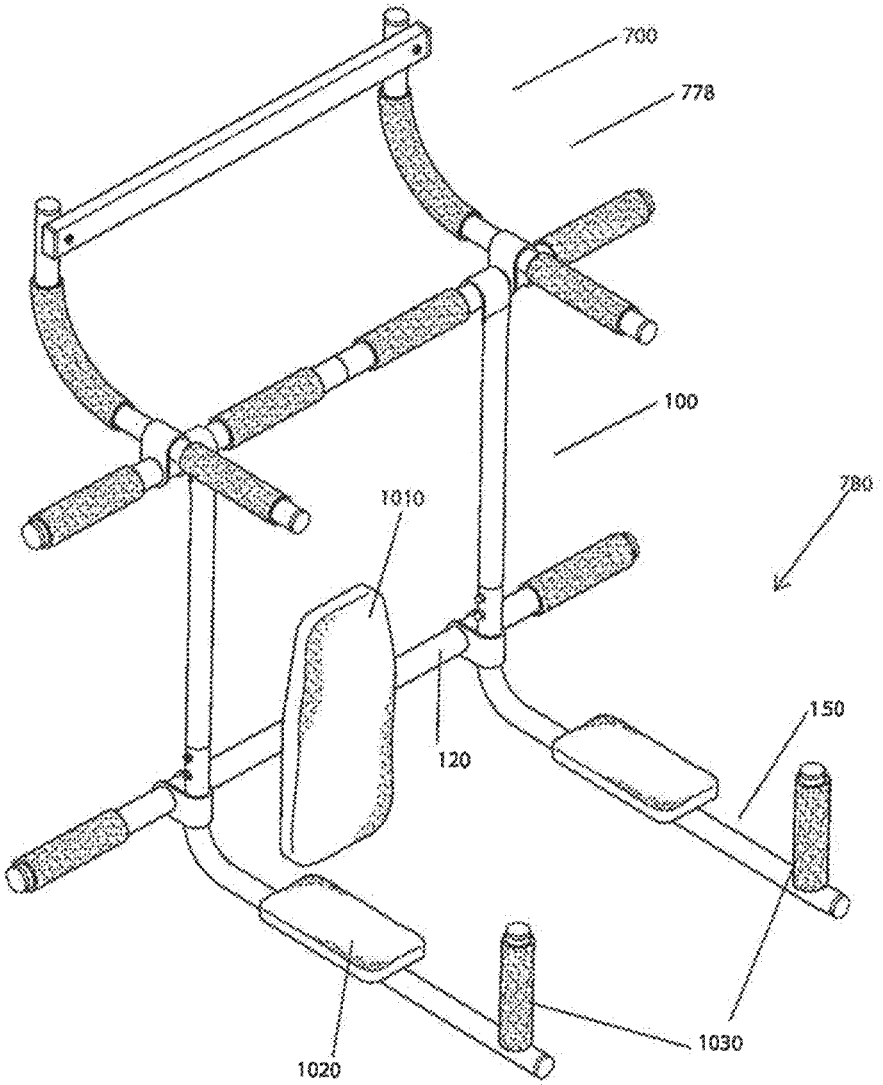

This is further illustrated in FIGS. 17 and 18 which show cross-sectional views of the example exercise apparatus in FIG. 7 taken through the middle of the elongate rest member 120 and collar 225.

In FIG. 17, the left button 320A is not engaged with an elongate drop member 140. The v-shaped springs 322 are made of a resilient material which has been compressed creating a spring force which forces the two arms of the spring apart. This spring force pushes the peg through the opening 330 in the elongate rest member 120.

The right button 320B is engaged with an elongate drop member 140. The collar 225 has an opening 430 which is aligned with the opening 330B such that the right button 320B extends through and engages with both openings. When engaged, the button 320B secures the elongate drop member 140 to the elongate rest member 120 and restricts movement of the elongate drop member 140 along the length of the elongate rest member 120.

As seen in FIG. 18, when a user applies an inward force on the button 320, the button 320 is pushed into the elongate rest member 120 and is disengaged from the opening 430 in the collar 225. When not engaged with a button, the elongate drop member 140 and its collar 225 may slide freely along the length of the elongate rest member 120.

In other implementations, the elongate drop member 140 can be secured to the elongate rest member 120 by any other mechanisms including but not limited to bolts, welds, pegs or any frictional means which restricts the movement of the elongate drop members 140 along the length of the elongate rest member 120. In other implementations, the elongate drop members 140 and the elongate rest member 120 may be moulded from a single material.

When the exercise apparatus 100 is mounted on a bar such as a pull-up or chin-up bar as shown in FIGS. 1 and 2, the elongate drop members 140 extend down from the bar, and the elongate handle struts 150 are substantially horizontal.

The elongate rest member 120 should be longer than the width of the average doorframe to allow the rest surfaces 165 to extend past the opening of the doorway and to contact the doorframe 800 or wall 820. In some implementations, the elongate rest member 120 may be extendable so that it may be adjusted to fit different sized doorways.

In FIGS. 1 and 2, the bar 700 is provided by a doorframe mountable bar 700. The doorframe mountable bar 700 comprises two L-shaped members 710 (comprising drop member 764 and strut 773), a rest member 720, and a support beam 730. In this example implementation, the exercise apparatus 100 is mounted to the bar 700 by two hooks 130 which hook onto the doorframe mountable bar's horizontal member 720.

FIG. 2 shows a side elevation view of the example exercise apparatus mounted on a doorframe 800. The doorframe 800 and wall surfaces 810, 820 are shown in dotted lines. The support beam 730 is positioned to rest on sill 804 of the doorframe 800 which supports the bar 700 and exercise apparatus 701 from falling. The apparatus 701 hangs from the doorframe 800 in doorway 806 (see FIG. 3 for example). A user hangs the bar 700 (upper exercise station 778) from the doorframe 800 then hangs the exercise apparatus 100 (lower exercise station 780) from the bar 700. Alternatively, the user can first hang the exercise apparatus 100 to the bar 700 and then hang the bar 700 from the doorframe 800. If the lower exercise station is fixed to the upper exercise station then a user simply hangs the apparatus 701 from the doorframe 800. When in use, a user exerts a downward force on the elongate handle struts 150 of the exercise apparatus 100. This downward force creates a torque which drives the rest surfaces 165 of the elongate rest member 120 towards the outer surface of the wall 810, and drives the support beam 730 towards the inner surface of the wall 820. The rest surfaces 165 act as a stop for the exercise apparatus and a fulcrum for the handle struts 150. The drop members 140 allow supported exercises to be performed on the handle struts 150. Supported exercises exert a downward force on the handle struts by pushing.

When the exercise apparatus is being used by a user, the bar and the exercise apparatus are held in place by the support beam 730 resting on the sill 830 and by frictional forces. The user's downward force on the bases 150 creates a normal force between the rest surfaces 165 and the outer surface 810 of the wall, and between the support beam 730 and the inner surface 820 of the wall. These normal forces increase the friction at the aforementioned contact points between the wall and the exercise apparatus 100 and bar 700. The increased friction helps prevent the exercise apparatus 100 and bar 700 from movement during use.

In some implementations, the bar's horizontal member (rest member 720) may, during use of the lower exercise station 780, form another contact point with the wall and may help resist slippage in the manner described above.

Figure 19:
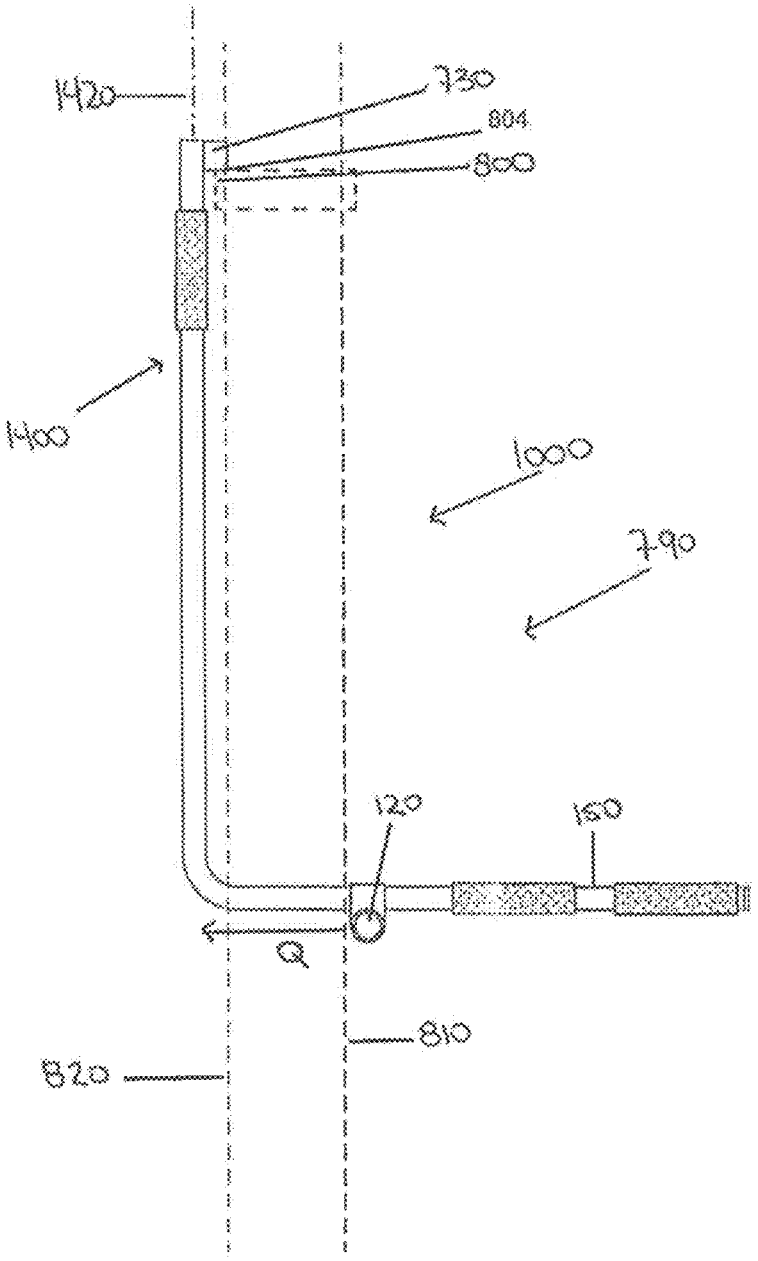
FIG. 19 is a perspective view of an implementation of a hanging exercise device similar to that of FIG. 7 with an example implementation of a rest member with offset intermediate section.

Referring to FIG. 19, in accordance with another example implementation, the elongate rest member 120 can comprise an intermediate section 121 offset from the longitudinal axis of the rest member in the direction Q away from the handle struts 150. The intermediate section 121 is also offset from the plane of the drop members 150 away from the handle struts 150. The offset section 121 can provide additional access to an upper exercise station, such as rest member 720. The section 121 can be U-shaped which extends away from the longitudinal axis 144 of the elongate rest member 120 in the direction of the rest surfaces 165. The section 121 creates a cavity 600 between the elongate drop members 140 to allow a user to perform exercises on the horizontal member, such as rest member 720 to which the exercise device 100 is attached without interference from the rest member 120.

FIG. 20 illustrates another example implementation in which the exercise apparatus 100 additionally has a backrest 1010 in the middle of the elongate rest member 120, armrests 1020 on the top of the elongate handle struts 150, and handlebars 1030 extending upwards from the ends of the elongate handle struts 150. These optional additions can provide alternative exercise positions, additional support, or comfort to the user. In some implementations, these additions may be removable allowing them to be attached or detached from the exercise apparatus 100 at the user's desire.

Figure 21:
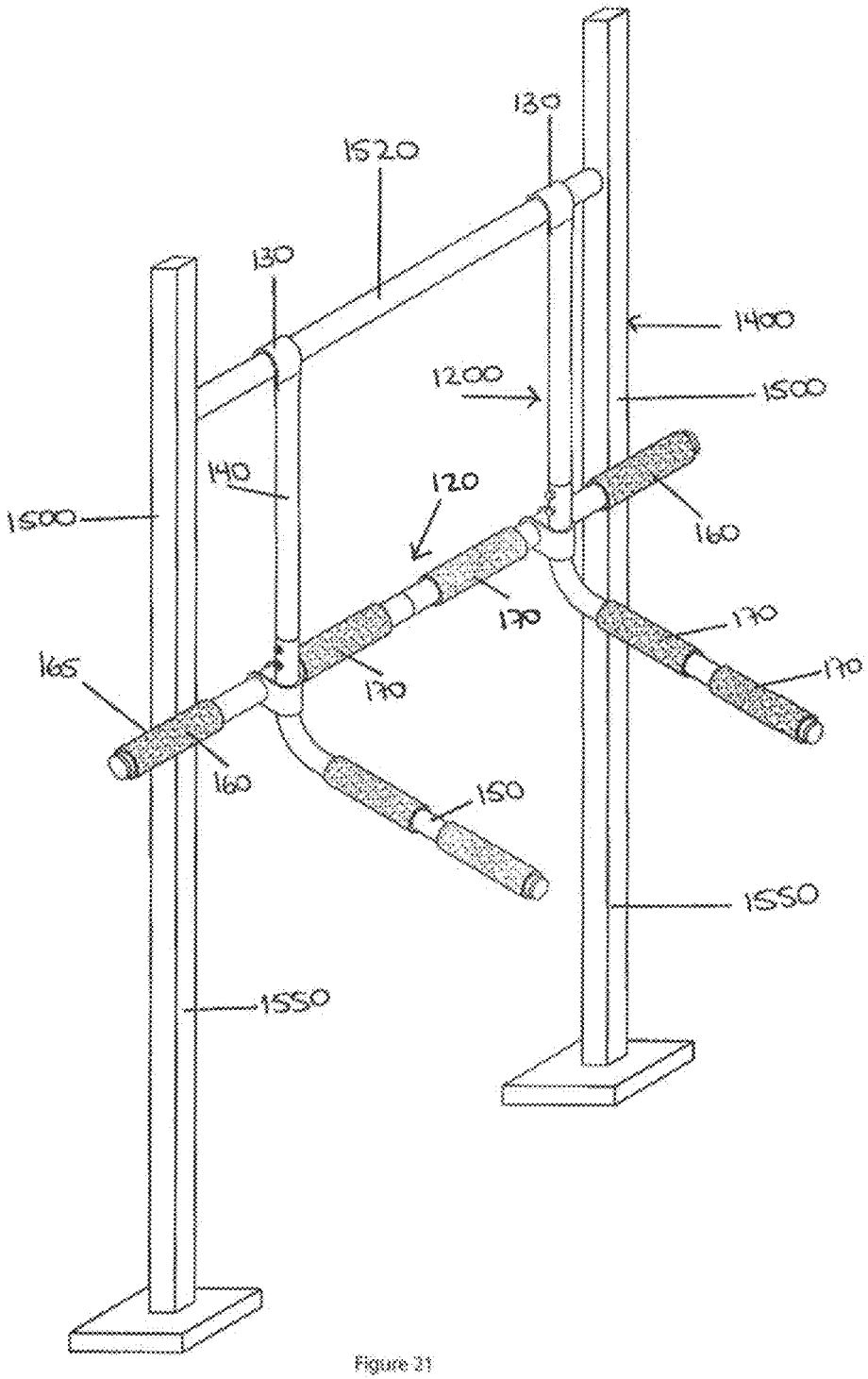
FIG. 21 is a perspective view of a further alternate exercise apparatus hanging from a freestanding exercise station.

Referring to FIG. 21, a further example implementation of an exercise apparatus 1200 in use with a free standing exercise station 1400 having two posts 1500 holding up an exercise bar 1520. The posts 1500 provide a further example of vertical surfaces 1550 with which rest surfaces 165 can engage. The apparatus 1400 is similar to the apparatus 100. In the apparatus 1200 the rest member 120 is connected to the drop members 140 and the handle struts extend from the drop members 140 past the rest member 120. The apparatus 1200 provides an offset between the drop members 140 and the rest member 120 to at least partially compensate for any offset between the bar 1520 and the vertical surfaces 1550. The rest member 120 and the drop members 140 can be configured in alternate relationships, some of which have been described in other implementations herein, to align with the station 1400 as desired.

Figure 22:
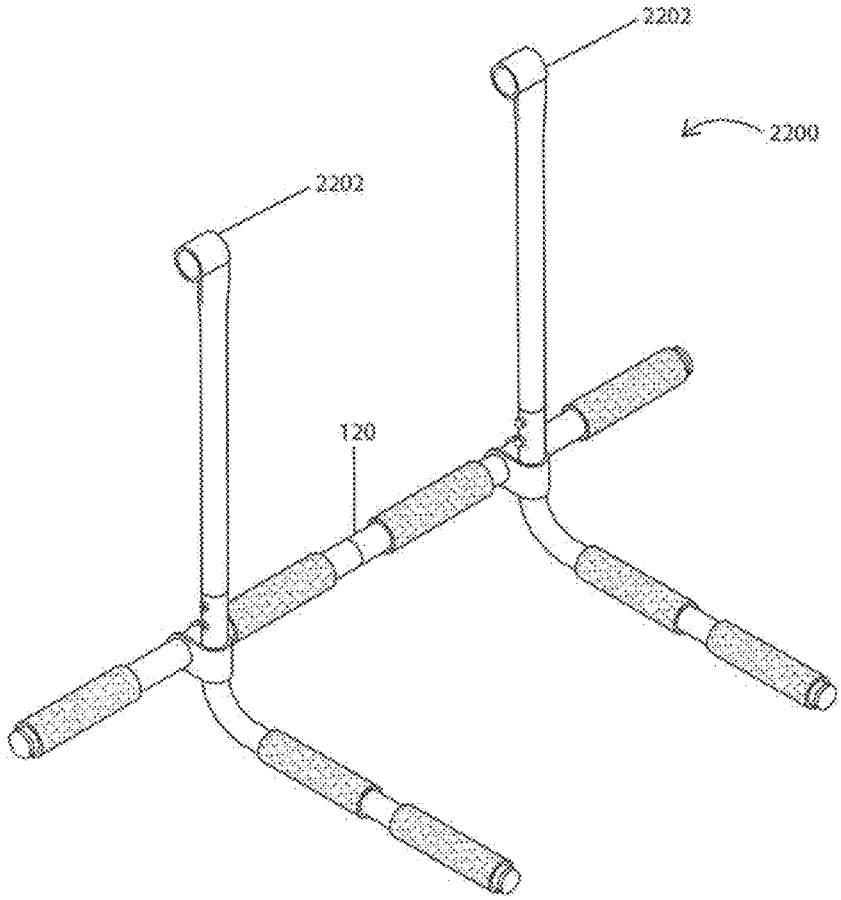
FIG. 22 is a perspective view of an alternate hanging exercise apparatus with rings.

Referring to FIG. 22 an alternate hanging exercise apparatus 2200 is similar to exercise apparatus 100; however, rings 2202 are provided in place of hooks 130. Rather than hooking over an exercise bar, such as rest member 770 of FIG. 7, the rings 2202 can slide onto the rest member 770. In order to provide sufficient distance between the rings 2202 to allow access over the ends of the rest member 770, the rest member 120 of the apparatus 2200 can be broken apart or extended, for example using the opposite process to that described with regard to FIG. 12, then the rings placed over the ends of rest member 770, and the rest member 120 reassembled. A quick release mechanism, such as pegs 321 could be incorporated into the rest member 120 in place of the bolts 224. Alternatively, the bar 770 could be provided with mechanism to open space in the bar to allow the rings 2202 to be placed over the rest member 770 and then reassembling the rest member 770. Other means by which to releasably attach the drop members 140 will be evident to those skilled in the art based on the information provided in this description and the drawings.

The above-described implementations of the present application are intended to be examples only. Alterations, modifications and variations may be effected to the particular implementations by those skilled in the art without departing from the scope of the application, which is defined by the claims appended hereto.

What is claimed is:

1. An exercise apparatus comprising:

a first pair of rigid elongate spaced-apart drop members, each drop member having a longitudinal axis, the longitudinal axes of the drop members being substantially in a single plane;

a rigid elongate first rest member having a longitudinal axis, the rest member having a length greater than the drop members are spaced apart such that opposing ends of the rest member extend beyond the spaced-apart drop members in a direction perpendicular to the longitudinal axis of the drop members, the rest member comprising two rest surfaces substantially parallel to the rest member longitudinal axis, the rest surfaces located at the opposing ends of the rest member;

a first pair of rigid elongate handle struts spaced apart by at least hip width, each handle strut having a longitudinal axis, the strut axes being substantially in a single plane and located inwardly with respect to said rest surfaces;

wherein the rest member is rigidly connected at least to the drop members or to the handle struts, and the handle struts are rigidly connected at least to the respective drop members or to the rest member, and the drop members are rigidly connected at least to the respective handle struts or to the rest member;

wherein the rest surfaces are offset in a first direction from the longitudinal axis of the rest member, and the strut members extend away from the longitudinal axis of the rest member in a second direction having a component opposite to the first direction; and wherein the drop members each have a free end from which they depend, each free end comprising an attachment means for releasably mounting the exercise apparatus in an operable position, wherein the attachment means is configured to rotatably engage a mounting bar.

2. The apparatus of claim 1 wherein the handle struts have a length of about one cubit.

3. The exercise apparatus of claim 1 wherein the longitudinal axis of each drop member is in the same plane as the longitudinal axis of a respective one of the handle struts.

4. The exercise apparatus of claim 1 wherein the distance the handle struts are spaced apart is adjustable.

5. The exercise apparatus of claim 1 wherein the releasable attachment means is selected from the group comprising hooks, pins, rings, clips, ropes, loops, and straps.

6. The exercise apparatus of claim 1 wherein the releasable attachment means comprise a hook, pin, ring, clip, rope, loop, or strap on each drop member.

7. The exercise apparatus of claim 1 wherein the drop members, the rest member and the handle struts are tubular.

8. The exercise apparatus of claim 1 wherein at least one rigid elongate member is tubular.

9. The exercise apparatus of claim 1 wherein at least one rigid elongate member is rectangular in cross section.

10. The exercise apparatus of claim 1 wherein grip portions on the elongate members are rounded in cross section.

11. The exercise apparatus of claim 5 wherein the mounting bar is in the form of a tube.

12. The exercise apparatus of claim 1 further comprising a backrest connected to the elongate rest member.

13. The exercise apparatus of claim 1 further comprising one or more armrests connected to the handle struts.

14. The exercise apparatus of claim 1 further comprising one or more handles connected to the handle struts.

15. The exercise apparatus of claim 1 further comprising one or more handles connected to the elongate rest member.

16. The exercise apparatus of claim 1 wherein the distance from an upper end of the drop members to the handle struts along a drop members axis of between about 15 and 25 inches.

17. The exercise apparatus of claim 1 wherein the elongate drop members have adjustable lengths.

18. The exercise apparatus of claim 1 wherein the handle struts have adjustable lengths.

19. The exercise apparatus of claim 1 further comprising one or more additional pairs of handle struts extending away from the rest member in a direction opposite the rest surface.

20. The exercise apparatus of claim 1 wherein the elongate handle struts are nonlinear such that when adjustably positioned, the distance between the axes of the elongate handle struts is adjustable.

21. The exercise apparatus of claim 1 wherein the elongate rest member comprises an intermediate section offset from the longitudinal axis of the rest member away from the handle struts.

22. The exercise apparatus of claim 21 wherein the intermediate section is also offset from the plane of the drop members away from the handle struts.

23. The exercise apparatus of claim 1 wherein the rest surfaces each include a surface area, the surface areas of the rest surfaces being spaced apart by at least a width of a doorway opening.

24. An exercise apparatus comprising:

a first pair of rigid elongate spaced-apart drop members, each drop member having a longitudinal axis, the longitudinal axes of the drop members being substantially in a single plane;

a rigid elongate first rest member having a longitudinal axis, the rest member having a length greater than the drop members are spaced apart such that opposing ends of the rest member extend beyond the spaced-apart drop members in a direction perpendicular to the longitudinal axis of the drop members, the rest member comprising two rest surfaces substantially parallel to the rest member longitudinal axis, the rest surfaces located at the opposing ends of the rest member;

a first pair of rigid elongate handle struts spaced apart by at least hip width, each handle strut having a longitudinal axis, the strut axes being substantially in a single plane and located inwardly with respect to said rest surfaces;

wherein the rest member is rigidly connected at least to the drop members or to the handle struts, and the handle struts are rigidly connected at least to the respective drop members or to the rest member, and the drop members are rigidly connected at least to the respective handle struts or to the rest member; and wherein the rest surfaces are offset in a first direction from the longitudinal axis of the rest member, and the strut members extend away from the longitudinal axis of the rest member in a second direction having a component opposite to the first direction;

a second pair of rigid spaced-apart drop members, each drop member having a longitudinal axis, the longitudinal axes of the drop members being substantially in a single plane;

a rigid elongate second rest member having a longitudinal axis, the rest member having a length substantially the same as the first rest member, the second rest member comprising two rest surfaces substantially parallel to the second rest member longitudinal axis, the rest surfaces located at opposing ends of the rest member, the opposing ends of the second rest member extending beyond the second pair of spaced-apart drop members in a direction perpendicular to the longitudinal axis of the second pair of drop members; and wherein the second rest member is rigidly connected to the second pair of drop members, and the second pair of drop members are rigidly connected at least to respective second pair handle struts or to the second rest member;

wherein the second rest member rest surfaces are substantially parallel to the plane of the second pair of drop members, the second rest member rest surfaces are offset in the first direction from the longitudinal axis of the second rest member;

wherein the first drop members attach to the second rest member, and the first pair of handle struts are separated from the second pair of handle struts by the first pair of drop members.

25. The apparatus of claim 24 further comprising a second pair of rigid elongate spaced-apart handle struts, each second pair handle strut having a longitudinal axis, the strut axes being substantially in a single plane; and the second pair handle struts are rigidly connected at least to the second drop members or to the second rest member;

and the second pair strut members extend away from the longitudinal axis of the second rest member in a third direction having a component opposite to the first direction.

26. The exercise apparatus of claim 24 wherein the first pair of drop members are fixedly attached to the second rest member.

27. The exercise apparatus of claim 24 wherein the first pair of drop members are releasably attached to the second rest member.

28. The exercise apparatus of claim 24 wherein the first pair of drop members are rotatably attached to the second rest member.

29. The exercise apparatus of claim 24 wherein each of the first pair of drop members terminates in a respective hook that is releasably attachable to the second rest member.

30. The exercise apparatus of claim 25 wherein the plane of the second pair of drop members is offset from the first and second rest surfaces in a direction away from the first and second handle struts, and the second pair of drop members terminate in a hanging mechanism.

31. An exercise apparatus comprising:

a first pair of rigid elongate spaced-apart drop members, each drop member having a longitudinal axis, the longitudinal axes of the drop members being substantially in a single plane;

a rigid elongate first rest member having a longitudinal axis, the rest member having a length greater than the drop members are spaced apart such that opposing ends of the rest member extend beyond the spaced-apart drop members in a direction perpendicular to the longitudinal axis of the drop members, the rest member comprising two rest surfaces substantially parallel to the rest member longitudinal axis, the rest surfaces located at the opposing ends of the rest member;

a first pair of rigid elongate handle struts spaced apart by at least hip width, each handle strut having a longitudinal axis, the strut axes being substantially in a single plane and located inwardly with respect to said rest surfaces;

wherein the rest member is rigidly connected at least to the drop members or to the handle struts, and the handle struts are rigidly connected at least to the respective drop members or to the rest member, and the drop members are rigidly connected at least to the respective handle struts or to the rest member;

wherein the rest surfaces are offset in a first direction from the longitudinal axis of the rest member, and the strut members extend away from the longitudinal axis of the rest member in a second direction having a component opposite to the first direction; and wherein the elongate rest member comprises an intermediate section offset from the longitudinal axis of the rest member away from the handle struts.

32. An exercise apparatus comprising:

a first pair of rigid elongate spaced-apart drop members, each drop member having a longitudinal axis, the longitudinal axes of the drop members being substantially in a single plane;

a rigid elongate first rest member having a longitudinal axis, the rest member having a length greater than the drop members are spaced apart such that opposing ends of the rest member extend beyond the spaced-apart drop members in a direction perpendicular to the longitudinal axis of the drop members, the rest member comprising two rest surfaces substantially parallel to the rest member longitudinal axis, the rest surfaces located at the opposing ends of the rest member;

a first pair of rigid elongate handle struts spaced apart by at least hip width, each handle strut having a longitudinal axis, the strut axes being substantially in a single plane and located inwardly with respect to said rest surfaces;

wherein the rest member is rigidly connected at least to the drop members or to the handle struts, and the handle struts are rigidly connected at least to the respective drop members or to the rest member, and the drop members are rigidly connected at least to the respective handle struts or to the rest member;

wherein the rest surfaces are offset in a first direction from the longitudinal axis of the rest member, and the strut members extend away from the longitudinal axis of the rest member in a second direction having a component opposite to the first direction;

wherein the elongate rest member comprises an intermediate section offset from the longitudinal axis of the rest member away from the handle struts; and wherein the intermediate section is also offset from the plane of the drop members away from the handle struts.

* * * * *